US007771040B2

(12) United States Patent
Nakashima

(10) Patent No.: US 7,771,040 B2
(45) Date of Patent: Aug. 10, 2010

(54) IMAGE FORMING APPARATUS AND TRANSFER BELT USED THEREIN

(75) Inventor: Atsuhisa Nakashima, Handa (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 130 days.

(21) Appl. No.: 10/490,430

(22) PCT Filed: Mar. 7, 2003

(86) PCT No.: PCT/JP03/02761

§ 371 (c)(1),
(2), (4) Date: Mar. 24, 2004

(87) PCT Pub. No.: WO03/076319

PCT Pub. Date: Sep. 18, 2003

(65) Prior Publication Data

US 2004/0246324 A1 Dec. 9, 2004

(30) Foreign Application Priority Data

Mar. 8, 2002 (JP) ..... 2002-062784
Jun. 21, 2002 (JP) ..... 2002-181312

(51) Int. Cl.
*B65H 5/02* (2006.01)

(52) U.S. Cl. ..... 347/104; 271/198; 271/275

(58) Field of Classification Search ..... 347/104; 271/198, 275

See application file for complete search history.

(56) References Cited

U.S. PATENT DOCUMENTS 4,207,578 A * 6/1980 Marinoff ..... 347/35
5,040,000 A 8/1991 Yokoi ..... 347/30
5,051,761 A * 9/1991 Fisher et al. ..... 347/30
5,717,446 A 2/1998 Teumer et al. ..... 347/35
5,740,728 A * 4/1998 DeBarber et al. ..... 101/93
5,940,105 A * 8/1999 Hayami ..... 347/104
6,009,290 A 12/1999 Mochida ..... 399/162
6,672,705 B2 * 1/2004 Kitahara et al. ..... 347/42
6,846,061 B2 * 1/2005 Nakashima ..... 347/22

FOREIGN PATENT DOCUMENTS

JP A 57-131649 8/1982
JP A-02-048958 2/1990
JP A-02-278252 11/1990
JP A-04-163471 6/1992
JP A 4-333457 11/1992
JP A-05-077510 3/1993
JP U 5-75246 10/1993
JP B2 6-593 1/1994
JP A 8-216400 8/1996
JP A 9-146386 6/1997

(Continued)

*Primary Examiner*—Jill E Culler
(74) *Attorney, Agent, or Firm*—Oliff & Berridge, PLC

(57) ABSTRACT

A transfer belt has a two-layer structure consisting of two inner belts formed of metal, such as stainless steel, and an outer belt formed of an elastic material, such as silicone rubber, being spread across the inner belts. The inner belts are endless and wound around transfer rollers, while the outer belt has its ends which are not joined with each other and form an opening therebetween. Distortion of the outer belt due to stress is designed to be suppressed by using a reinforcing member around the opening.

18 Claims, 17 Drawing Sheets

FOREIGN PATENT DOCUMENTS

| | | |
|---|---|---|
| JP | B2 2693224 | 9/1997 |
| JP | B2 2817964 | 8/1998 |
| JP | A 2000-159372 | 6/2000 |
| JP | A 2000-211159 | 8/2000 |
| JP | A 2000-247475 | 9/2000 |
| JP | A 2001-105628 | 4/2001 |
| JP | A 2001-113690 | 4/2001 |
| JP | A 2001-130776 | 5/2001 |
| JP | A 2001-287377 | 10/2001 |

* cited by examiner

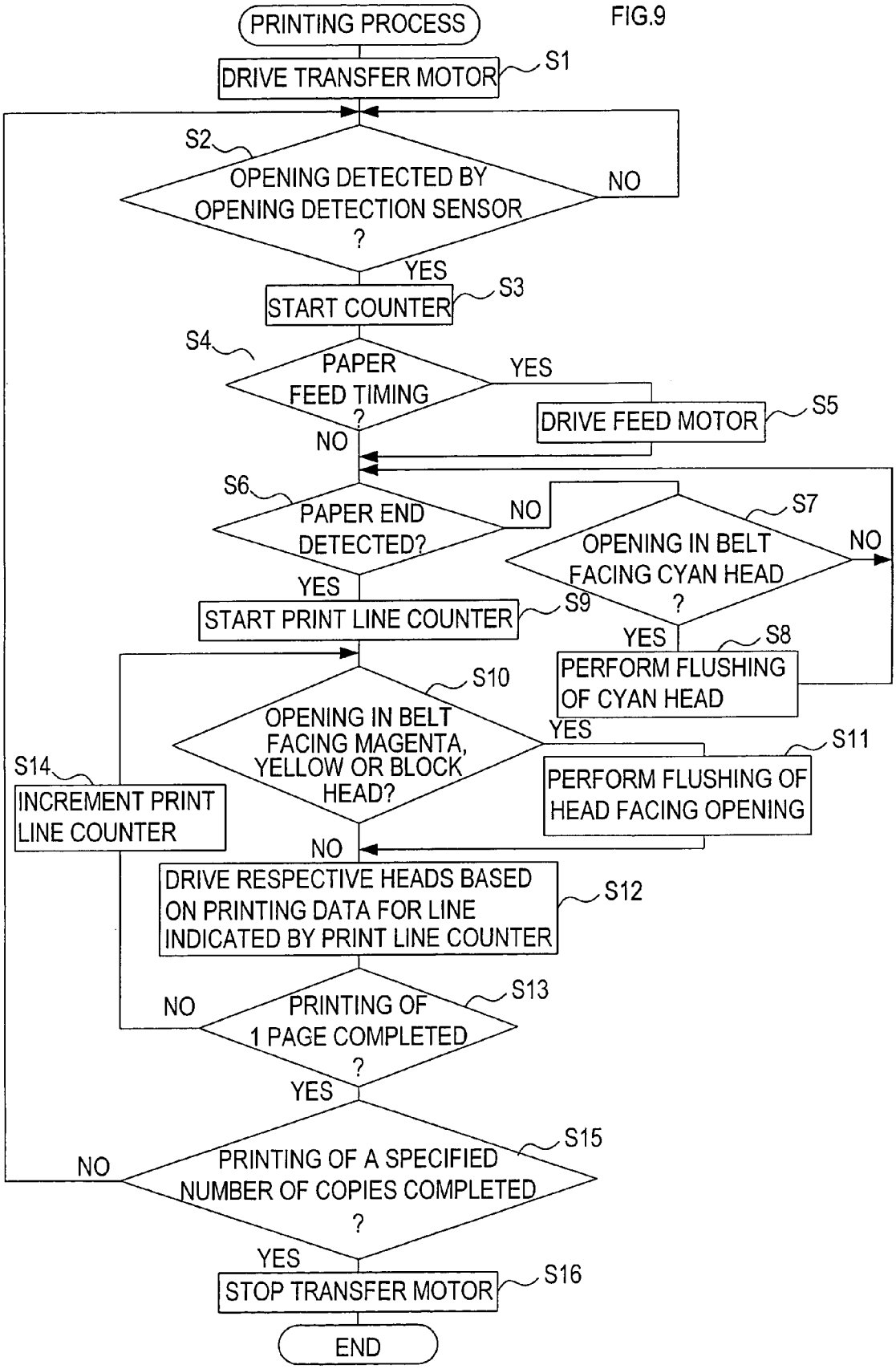
FIG.9
PRINTING PROCESS
DRIVE TRANSFER MOTOR
S1
S2
OPENING DETECTED BY OPENING DETECTION SENSOR ?
NO
YES
START COUNTER
S3
S4
PAPER FEED TIMING ?
YES
DRIVE FEED MOTOR
S5
NO
S6
PAPER END DETECTED?
NO
S7
OPENING IN BELT FACING CYAN HEAD ?
NO
YES
START PRINT LINE COUNTER
S9
YES
S8
PERFORM FLUSHING OF CYAN HEAD
S10
OPENING IN BELT FACING MAGENTA, YELLOW OR BLOCK HEAD?
YES
S11
PERFORM FLUSHING OF HEAD FACING OPENING
S14
INCREMENT PRINT LINE COUNTER
NO
DRIVE RESPECTIVE HEADS BASED ON PRINTING DATA FOR LINE INDICATED BY PRINT LINE COUNTER
S12
S13
NO
PRINTING OF 1 PAGE COMPLETED ?
YES
S15
NO
PRINTING OF A SPECIFIED NUMBER OF COPIES COMPLETED ?
YES
STOP TRANSFER MOTOR
S16
END

IMAGE FORMING APPARATUS AND TRANSFER BELT USED THEREIN

FIELD OF THE INVENTION

The present invention relates to an image forming apparatus, such as an ink jet printer, and a transfer belt used in the image forming apparatus.

BACKGROUND ART

Image forming apparatuses, which record images and the like on recording media, such as paper and cloth, while transferring these recording media, have been conventionally used extensively. In some image forming apparatuses, transfer of a recording medium using a transfer belt (belt transfer system) is employed since the recording medium can be transferred in a rapid and stable manner by this system.

In the belt transfer system, an endless transfer belt is wound around a plurality of transfer rollers, and the transfer belt is fed by rotationally driving these transfer rollers by some power device. Then, a recording medium is fed onto the transfer belt from a supply portion. In an ink jet printer, for example, the recording medium is transferred to an image forming area under a print head, in which an image is formed by discharging ink from the print head and recorded on the recording medium. After the recording operation is performed, the recorded recording medium is discharged from a discharge portion by the transfer belt.

The transfer belt is mostly made of an elastic material in order to facilitate processing of the belt, such as adhesion processing on the surface of the belt for securely holding a recording medium. In the case of a large image forming area, the transfer belt is required to be long and, therefore, is prone to have deflection or distortion in itself. Then, the recording medium, which is transferred intermittently by the transfer belt, sometimes does not follow the belt or departs from the belt due to inertial force. As a result, the recording medium may also be deflected or positionally displaced by the influence of the deflection or distortion of the belt.

In a commonly used ink jet printer among various image forming devices, recording is performed by ejecting ink in a nozzle of a print head as droplets of ink directly onto the recording medium by means of pressure of a piezoelectric element or thermal foaming. In the vicinity of ink discharge ports of the print head, volatile components such as water in ink evaporate with time, which leads to a drier ink having an increased viscosity. In an on-demand ink jet printer, in which whether or not to discharge ink is determined based on the data to be recorded, especially an ink discharge port with a low frequency of ink discharge will have problems, such as unstable ink discharge from the print head and inability to discharge ink due to an increased viscosity of ink. To avoid these problems, ink discharge called recovery discharge is preformed in addition to ink discharge onto the recording medium so that ink with an increased viscosity can be expelled from the nozzle.

Specifically, in most cases of a serial printer, in which a print head having ink discharge ports arranged in the transfer direction of the recording medium is scanningly moved in a direction perpendicular to the transfer direction of the recording medium so as to record an image for one line, an ink reservoir for recovery discharge is provided close to the position which the recording medium passes such that the print head is moved to the position of the ink reservoir when recovery discharge is to be performed.

With respect to a line printer, in which an elongated print head having ink discharge ports arranged in the width direction of a recording area of the recording medium and recording is performed without scanning movement of the print head, there is known technology in which the entire elongated print head is moved to a position not facing the transfer belt in order to perform recovery discharge. However, such movement of the print head takes a long time period, which makes it impossible to take advantage of high speed printing without scanning movement of the print head.

The below-mentioned Patent Document 1 includes disclosure that an opening of a size corresponding to the width of ink discharge of a print head is provided in a transfer belt and that recovery discharge of the print head is performed at the position of the opening in order to solve these problems.

When an opening such as a hole is provided in a transfer belt, however, there is another problem. Specifically, since the belt is distorted or deflected around the opening due to stress concentrated around the opening, a recording medium cannot be properly held, and therefore the recording medium may be separated from the transfer belt or deflected.

[Patent Document 1]

Publication of Unexamined Japanese Patent Application No. 2001-287377

DISCLOSURE OF THE INVENTION

An object of the present invention is to provide an image forming apparatus capable of appropriately transferring a recording medium while preventing deflection and distortion of a transfer belt having an opening.

Another object of the present invention is to provide a transfer belt suitable for use in the image forming apparatus as above.

A further object of the present invention is to provide a fixing structure of the transfer belt (transfer sheet) as above.

To attain these and other objects, an image forming apparatus of the present invention is provided with a transfer mechanism for transferring a recording medium which comprises: at least two rollers arranged at a predetermined distance apart from each other, at least one of the rollers being rotationally driven; an inner belt layer including two inner belts circularly wound around the at least two rollers at a predetermined distance apart from each other; and an outer belt layer arranged so as to abut the outer surfaces of the inner belts for placing the recording medium thereon, the outer belt layer rotating with the inner belts, wherein the outer belt layer has an opening for allowing recovery discharge of the print head and a reinforcing portion provided around the opening for maintaining the configuration of the opening.

In the image forming apparatus constituted as above, there is provided a two-layer structure consisting of the outer belt layer for placing the recording medium thereon and the inner belt layer of two inner belts arranged inside the outer belt layer. Accordingly, holding power to hold the recording medium and strength required to a transfer belt are shared, respectively, by the outer belt layer and the inner belt layer. Also, the two-layer structure allows the inner belts to be left unreplaced and only the outer belt to be replaced during maintenance and regular replacement procedure, which may reduce the time required for replacement and the cost for replacement parts. It is also possible to recover the discharge ability of the print head of the image forming apparatus, such as an ink jet printer, comprising the transfer belt by allowing the print head to discharge ink toward the opening provided to the outer belt layer. Furthermore, the reinforcing portion provided around the opening to which stress is applied reinforces the opening so as to prevent the outer belt layer from being deflected or distorted due to the stress. Accordingly, the recording medium is prevented from being separated from the transfer belt or deflected, and recording of an image can be properly performed.

It is preferable that the respective inner belts are disposed, respectively, at both side ends of the outer belt layer. This prevents the inner belts from covering the opening for recovery discharge, so that required size of the opening is secured.

It is preferable that the inner belts are made of a material having a higher strength than the material of the outer belt layer. Since the outer belt layer is held by the inner belts having a high strength, occurrence of distortion of the outer belt layer can be minimized, even if a tension is applied onto the outer belt layer holding the recording medium.

The material of the inner belts is, for example, metal, while the material of the outer belt layer is, for example, synthetic resin.

The outer belt layer preferably includes a base belt layer as a base and an adhesive belt layer provided on the base belt layer for placing the recording medium thereon. This structure enables the adhesive belt layer, on which the recording medium is placed, to be held with an appropriate tensile strength. Also, since the recording medium is held on the adhesive belt layer by a prescribed adhesion, occurrence of positional deviation of the recording medium during transportation process or printing process can be prevented.

It is preferable that the reinforcing portion has a U-shaped cross section and that the end of the base belt is held within the U-shaped reinforcing portion. This structure enables the reinforcing portion to be attached to the outer belt layer by only fitting the end of the base belt into the reinforcing portion.

When the outer belt layer is an open-ended belt, the both ends of the open-ended belt define the opening of the outer belt layer. Therefore, particular opening forming process is not necessary for forming the opening with the ends of the open-ended belt. The reinforcing portion is provided at least at one of the both ends of the open-ended belt. In this case, the reinforcing portion is preferably provided along the entire length of the end of the open-ended belt.

When the outer belt layer is an endless belt, the opening is provided in the endless belt. Since the opening may be provided at any place of the endless belt, it is possible to provide openings optimum for the image forming apparatus, which includes the outer belt layer, by freely adjusting the shape, angle and number of openings. In this case, the reinforcing portion is preferably provided so as to surround at least part of the opening. The reinforcing portion provided so as to surround the opening reinforces the opening subject to a tension, and thereby prevents deflection or distortion of the outer belt layer.

The reinforcing portion may be formed by increasing the thickness of part of the endless belt. The reinforcing portion may be provided to extend throughout the width of the outer belt layer perpendicular to the transfer direction.

Also, the opening may be provided obliquely with respect to the transfer direction of the outer belt layer. This structure, in which the opening is provided obliquely at a prescribed angle with respect to the transfer direction, reduces concentration of stress around the opening, resulting in prevention of deflection or distortion of the outer belt layer.

The outer belt layer includes an abutting portion for abutting an end of the recording medium when the recording medium is supplied to the transfer mechanism from the outside. The recording medium supplied to the transfer mechanism from the outside abuts the abutting portion, thereby being positioned on the outer belt layer. The abutting portion may include an end surface extending in a direction perpendicular to the transfer direction of the reinforcing portion.

The length of the reinforcing portion along the rotating direction of the roller is preferably one-tenths or less of the half of the circumferential length of the roller. In this arrangement, the length of the reinforcing portion is relatively small with respect to the length of the contact area between the roller and the belt in the rotating direction of the roller. Accordingly, the change in rotating speed of the belt can be inhibited even when the reinforcing portion travels in the contact area. This allows rotation of the outer belt layer without interference, and thus smooth rotation of the roller and the transfer belt in the transfer mechanism.

The transfer mechanism preferably further comprises a nip roller for placing the recording medium in close contact with the outer belt layer. This allows the recording medium to be stably placed on the outer belt layer (or on an adhesive belt layer when the outer belt layer includes the adhesive belt) in close contact therewith. Improvement in the quality of an image to be formed on the recording medium will thus be achieved.

When the reinforcing portion is provided with a projection having a predetermined configuration which projects from the outer belt, the nip roller is preferably provided with a receiving groove capable of receiving the projection of the reinforcing portion. This arrangement prevents the nip roller from running on to the reinforcing portion, achieving stable and smooth transfer.

When a nip roller is provided in an image forming apparatus, the inner belt is preferably provided with a member for preventing the nip roller from falling in the opening when the opening of the outer belt layer comes to the position of the nip roller. This arrangement prevents occurrence of level difference which will affect the transfer speed or cause bumpy movement and thereby distortion of the recording medium.

The preventing member preferably has a top portion extending longer than the length of the opening in the transfer direction. This surely prevents the nip roller from falling into the opening. The height of the top portion of the preventing member is equal to the thickness of the outer belt layer. The preventing member also may be formed to have a gentle slope by adjusting its height.

The image forming apparatus preferably comprises a detection device for detecting the position of the opening; and a control device for controlling the print head to perform recovery discharge when the opening faces the print head in response to a detection signal from the detection device, and for controlling the print head to perform ink discharge for forming an image on the recording medium.

This enables the print head to surely discharge ink toward an image forming area as well as discharge ink toward the opening. Particularly in a line printer, in which the print head does not move, it is possible to surely discharge ink toward the opening without providing an additional mechanism and also expel ink with an increased viscosity through a nozzle.

The image forming apparatus preferably further comprises a recording medium detection device for detecting the recording medium and a transfer control device for controlling transfer of the recording medium so as to abut the abutting portion in response to a detection output provided from the recording medium detection device.

According to the image forming apparatus constituted as above, it is possible to place the recording medium on the transfer belt such that the end of the recording medium abuts the abutting portion of the outer belt layer, based on the detection result by the recording medium detection device for detecting the recording medium, and then transfer the recording medium.

In another aspect of the present invention, there is provided a fixing structure of a transfer sheet having an upstream end and a downstream end in a transfer direction thereof that moves following a rotationally driven drive member and transfers a recording medium, on which an image is formed, placed on the surface of the transfer sheet. The fixing structure of a transfer sheet comprises an upstream reinforcing member provided at the upstream end of the transfer sheet in the transfer direction throughout the width of the transfer sheet; a fixing device for fixing the upstream reinforcing member to the drive member; and a slack prevention device for maintaining a state in which the transfer sheet is wound around the drive member without slack when the transfer sheet with the upstream reinforcing member fixed thereto by the fixing device is wound around the drive member.

According to the fixing structure of a transfer sheet, once the upstream reinforcing member is fixed to the drive member and wind the transfer sheet around the drive member, the slack prevention device holds the transfer sheet in a state in which the transfer sheet is wound around the drive member without slack, which facilitates attachment of the transfer sheet to the drive member.

The slack prevention device may be a biasing device for biasing the downstream end of the transfer sheet toward a predetermined fixing position of the drive member. An example of the biasing device is a spring.

The slack prevention device may be a resistance providing device that provides the transfer sheet with resistance in the opposite direction to the transfer direction when the transfer sheet is rotationally driven in the transfer direction.

The slack prevention device may include a downstream reinforcing member provided at the downstream end of the transfer sheet in the transfer direction thereof throughout the width of the transfer sheet and a guide member having a groove provided along the movement path of the downstream reinforcing member. In this case, the size of the groove should be selected so as to generate a predetermined amount of resistance when the downstream reinforcing member moves.

In a further aspect of the present invention, there is provided an outer belt for use in an image forming apparatus. The outer belt comprises: an open-ended belt body having a first surface for placing the recording medium thereon and a second surface for abutting the outer surfaces of the inner belts and being wound around the outer surfaces of the inner belts; an upstream reinforcing member provided at an upstream end of the open-ended belt body in the transfer direction thereof throughout the width of the open-ended belt body and able to be fixed at a predetermined position on the outer surfaces of the inner belts; and a downstream reinforcing member provided at a downstream end of the open-ended belt body in the transfer direction thereof throughout the width of the open-ended belt body, and able to be fixed to the inner belts so as to give a tension to the open-ended belt body when the upstream reinforcing member is fixed to the inner belts and the open-ended belt body is wound around the inner belts.

The outer belt designed to be detachably attached to the inner belts may be replaced when necessary, which achieves simplified maintenance operation and cost reduction.

BRIEF DESCRIPTION OF THE DRAWINGS

FIG. 9 is a flowchart illustrating the operation of the ink jet printer.

BEST MODE FOR PRACTICING THE INVENTION

Hereinafter, an embodiment of the present invention will be described with reference to the drawings.

Figure 1:
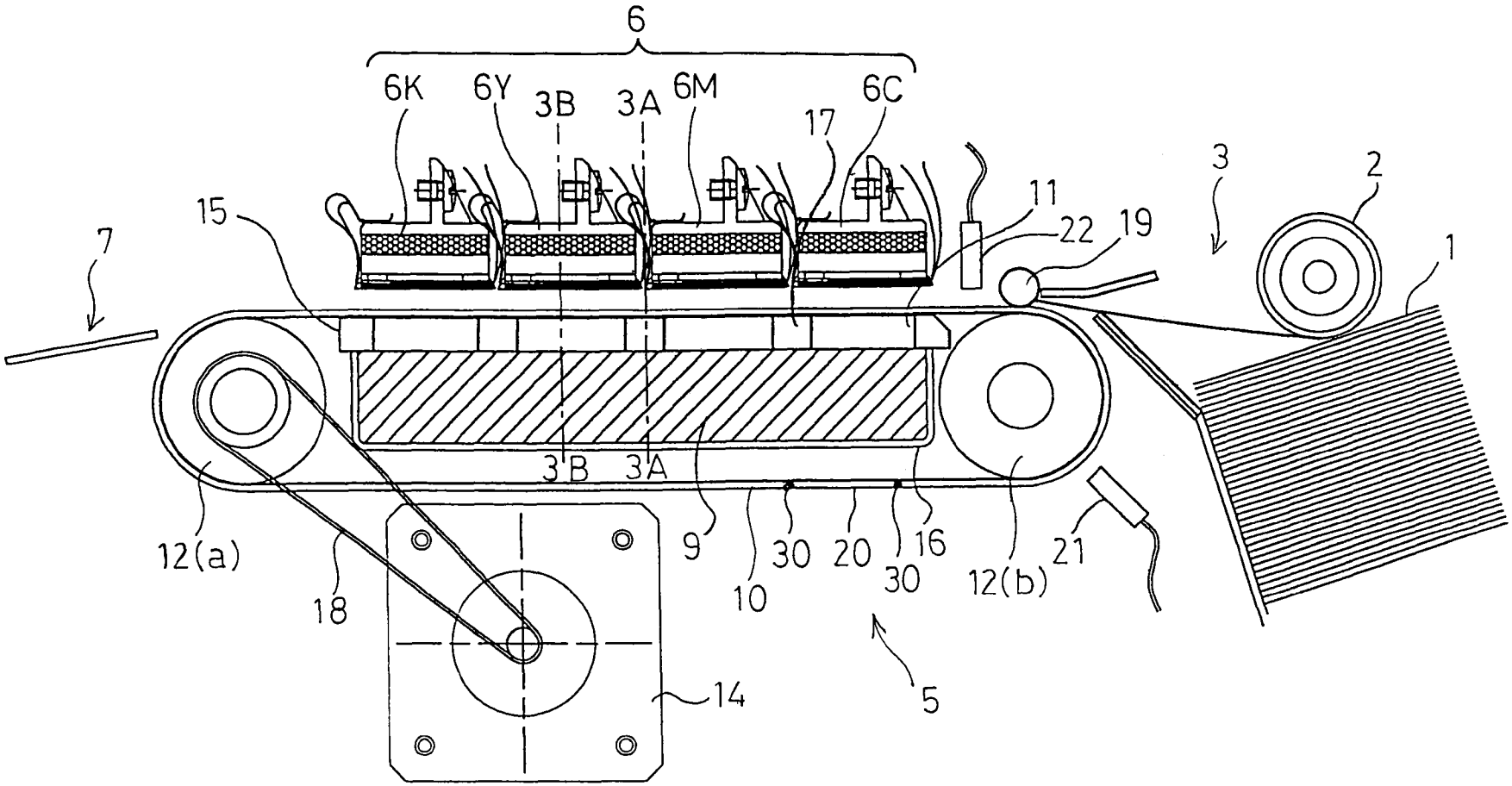
FIG. 1 is a schematic view illustrating the main part of an ink jet printer according to an embodiment of the present invention.

FIG. 1 is a schematic view illustrating the main part of an ink jet printer according to the embodiment of the present invention. The ink jet printer according to the present embodiment has the same basic structure as a general ink jet printer. As shown in FIG. 1, the ink jet printer comprises a supply portion 3 including a pickup roller 2 for feeding paper 1 as a recording medium, a transfer mechanism 5 for transferring the paper 1 supplied from the supply portion 3, a print head 6 of ink jet system, and a discharge portion 7 for discharging the paper 1.

The transfer mechanism 5 is provided with two transfer rollers 12, 12, a transfer belt 10 wound around the transfer rollers 12, 12, and a transfer motor 14 for driving one of the transfer rollers 12, 12 as a drive roller.

In the ink jet printer, the paper 1 is fed from the supply portion 3 toward the transfer belt 10, and is transferred by the transfer belt 10 to an image forming area under the print head 6. There, an image is formed on the paper 1 by discharge of ink from the print head 6 and is recorded. Then, the recorded paper 1 is transferred to the discharge portion 7.

The print head 6 includes a black ink head 6K for discharging black ink, a yellow ink head 6Y for discharging yellow ink, a magenta ink head 6M for discharging magenta ink, and a cyan ink head 6C for discharging cyan ink for performing color printing. Each ink print head 6K, 6Y, 6M, 6C is provided with a drive element, such as a piezoelectric element, used for discharging ink droplets from a discharge port, and is of a full-line type which comprises multiple ink discharge ports arranged throughout an area along the direction perpendicular to the transfer direction of the paper 1 within a recordable area of the paper 1. The ink heads 6K, 6Y, 6M, 6C are arranged in parallel with one another along the transfer direction of the transfer belt.

A belt guide 15 for guiding the transfer belt 10 is disposed under the print head 6, and an ink reservoir 16 is disposed under the belt guide 15. A sheet of foam 9 for collecting ink is placed in the ink reservoir 16. The belt guide 15 has through holes 11 for recovery discharge of the print head 6 arranged corresponding to the print head 6. The through holes 11 are separated by ribs 17, the upper surfaces of which serve as guide surfaces which contact the inner surface of an after-mentioned outer belt to guide the outer belt and maintain a prescribed distance between the outer belt and the print head 6. The size of the opening of each through hole 11 is larger than the size of the ink discharge area of each print head. The transfer belt 10 has an opening 20, which will be described in detail later. The opening 20 is reinforced by reinforcing members 30 so that the opening 20 will not be deformed even if stress is imposed around the opening 20.

Recovery discharge of the print head is performed in addition to ink discharge performed on the paper 1 for forming an image. Recovery discharge is to discharge ink toward the ink reservoir 16 through the above-mentioned opening 20 of the transfer belt 10 and the through hole 11 of the belt guide 15, so that unstable ink discharge due to an increased viscosity of ink in the vicinity of the ink discharge port can be avoided.

One of the transfer rollers 12 is a drive roller 12*a* to be driven by the transfer motor 14 as a drive device through a belt 18 fitted on the transfer roller 12*a*, while the other one is a follower roller 12*b*. The number of the transfer rollers should not be limited to two, but may be three, for example. In this case, one of the transfer rollers may be located below the other two transfer rollers such that a downward tension is generated.

At the position where the paper 1 is fed onto the transfer belt 10, a nip roller 19 is disposed facing the transfer roller 12 such that the nip roller 19 presses the paper 1 against the transfer belt 10 to assist the transfer belt in holding the paper 1. The nip roller 19 may follow the movement of the transfer roller 12 or may be a drive roller itself.

As shown in FIG. 1, an opening detection sensor 21 as an opening detection device for detecting the opening 20 of the transfer belt 10 and a paper end detection sensor 22 as a recording medium detection device for detecting an end of the paper are disposed in the vicinity of the follower roller 12*b*. The opening detection sensor and the paper end detection sensor here may be a reflection-type photo sensor or a photo interrupter.

Figure 2:
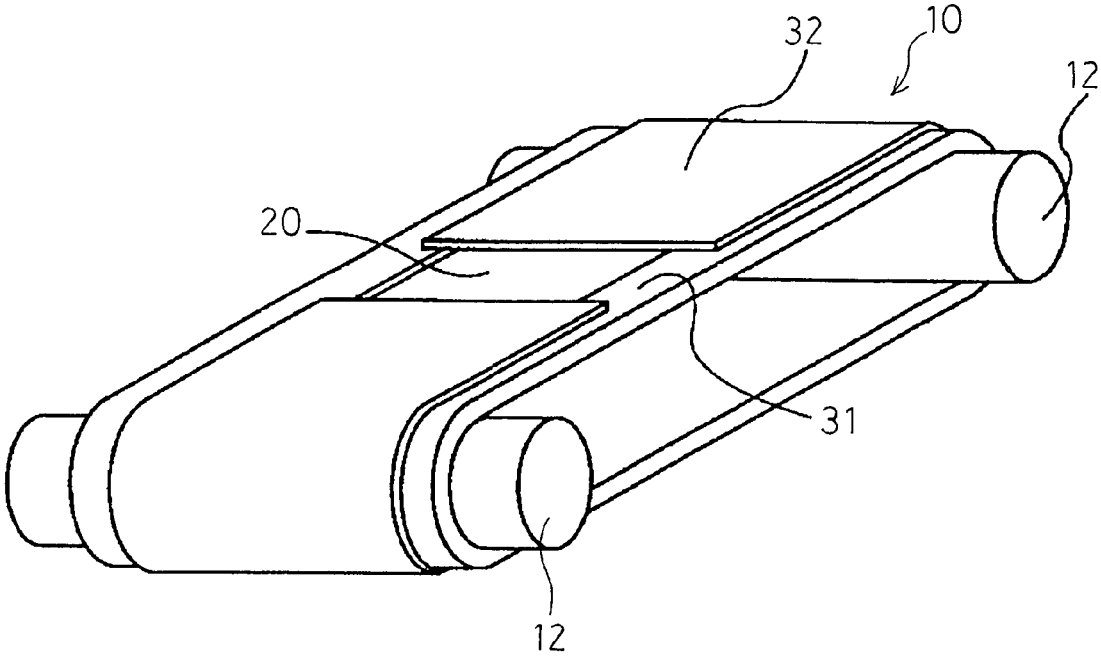
FIG. 2 is a schematic perspective view of a transfer mechanism.

As shown in FIG. 2, the transfer belt 10 has a two-layer structure consisting of inner belts 31 and an outer belt 32. The inner belts 31 are made of metal such as stainless steel, while the outer belt 32 is made of an easily processable elastic material such as synthetic resin, and is spread across the two inner belts 31. The inner belts 31 are endless and wound around the transfer rollers 12, 12, while the outer belt 32 has an upstream end and a downstream end in the transfer direction which are not joined with each other and form the opening 20 therebetween.

When ink around the ink discharge port is not discharged, the viscosity of ink is increased with time due to vaporization and drying, which may lead to unstable ink discharge or inability to discharge ink. Therefore, in a usual ink jet printer, ink discharge not for forming an image is preformed so that ink discharge ability of print heads may be recovered. This kind of ink discharge is mostly performed at predetermined time intervals for certainty purposes. This kind of ink discharge is called recovery discharge since it is to recover the discharge ability of the print head. The opening 20 is provided to perform such recovery discharge at predetermined time intervals. When the opening 20 comes right under the print head 1, ink is discharged from the print head 6 toward the opening 20, and thus recovery discharge can be performed without making the paper 1 or the transfer belt 10 dirty. Especially in the full-line type printer of the present embodiment, in which the printhead 6 does not move during printing, there is an advantage that recovery discharge can be performed at a fixed position without providing any other complex mechanism. That is, since recovery discharge can be performed when the opening 20 faces the print head 6 without moving the print head 6 to another position for recovery discharge, printing process time needs not be prolonged.

On the other hand, since the inner belts 31 made of metal have a high strength and are not deflected or distorted during their transfer process, occurrence of deflection of the outer belt 32 can be minimized by being held by the inner belts 31 even if a tension is applied onto the outer belt 32 during transfer of the paper 1.

Figure 7A:
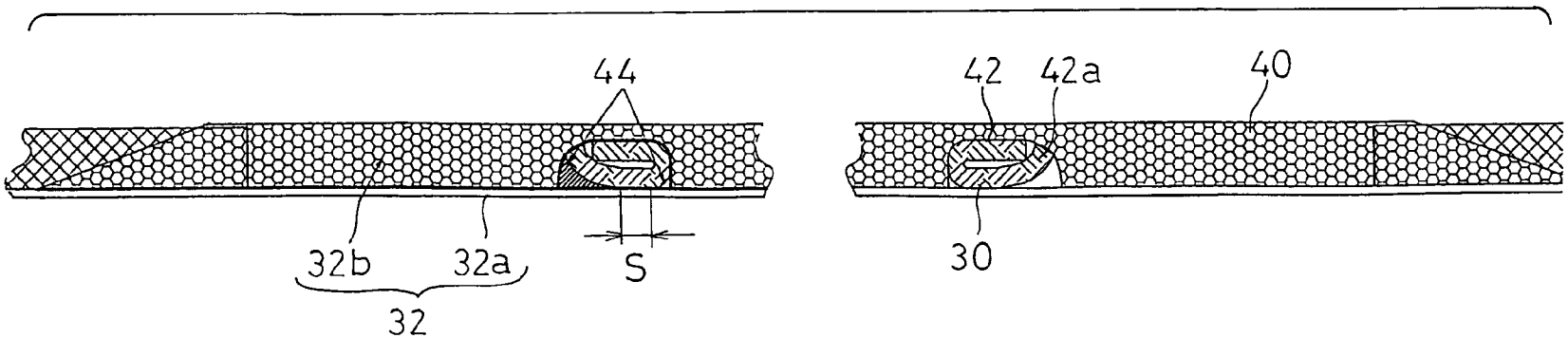
FIGS. 7A and 7B are partially broken sectional views illustrating an example of fixing structure of a reinforcing portion.
Figure 7B:
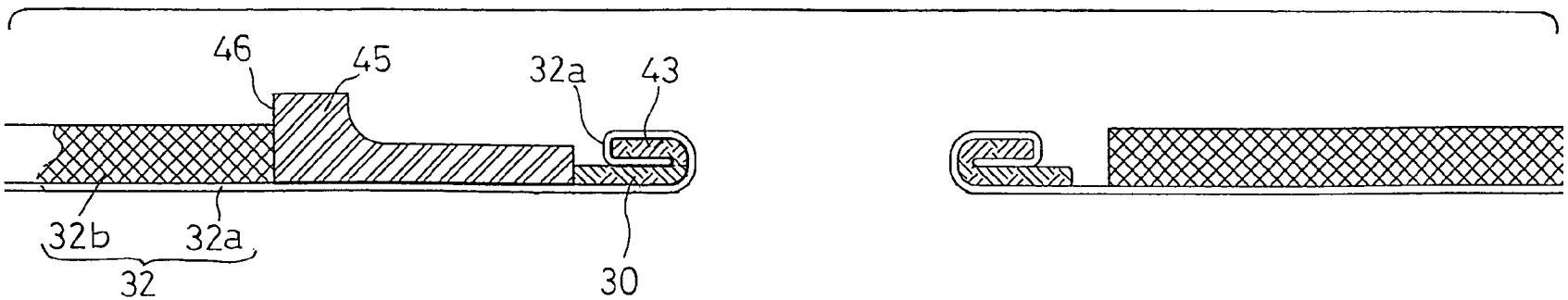

The structure of the outer belt in detail is illustrated in FIGS. 7A and 7B. As shown in the drawings, the outer belt 32 consists of a base belt 32*a* as a base and an adhesive layer 32*b* disposed on the base belt 32*a*. The adhesive layer 32*b* may preferably be made of silicone rubber, which is most suitable for holding the position and the posture of the paper by means of its adhesion.

Figure 3A:
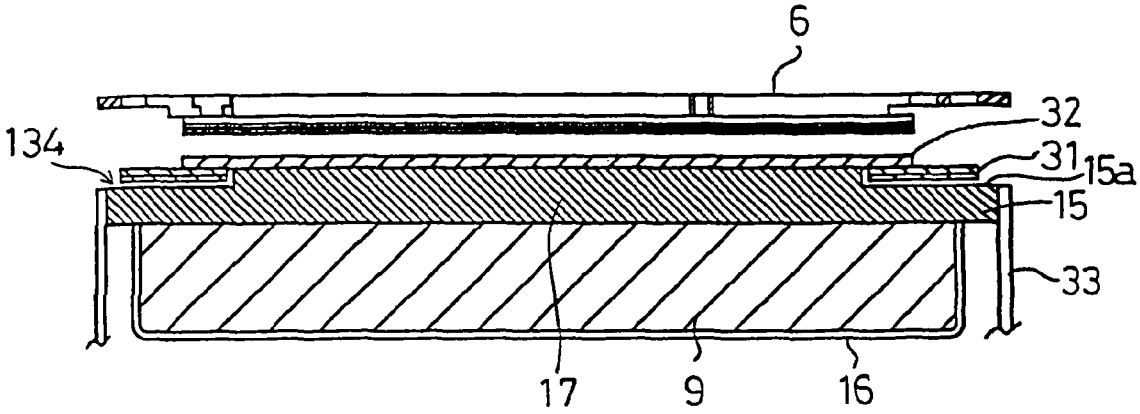
FIG. 3A is a sectional view along line 3A-3A of FIG. 1.
Figure 3B:
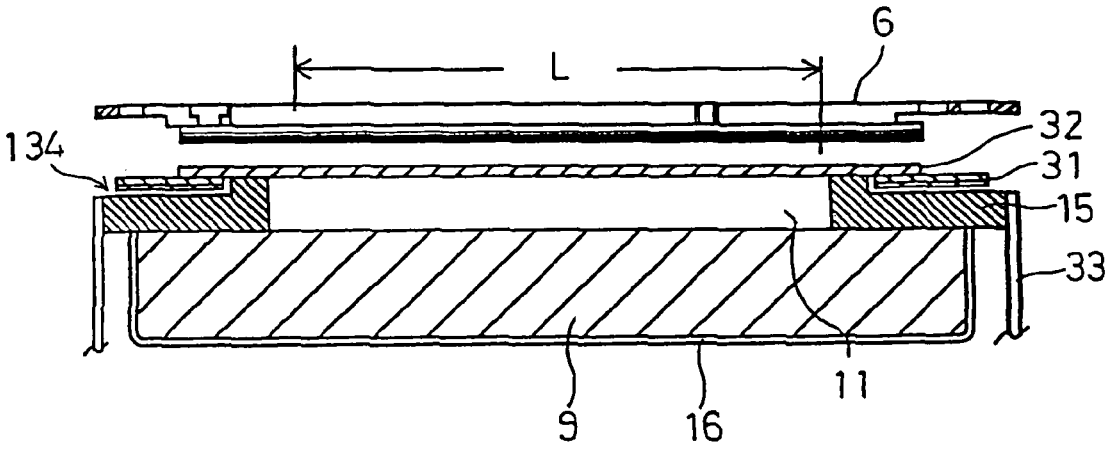
FIG. 3B is a sectional view along line 3B-3B of FIG. 1.

FIGS. 3A and 3B are sectional views of the area of the print head 6 and the vicinity thereof. Specifically 3A is a sectional view at the ribs 17 of the belt guide 15 (along line 3A-3A of FIG. 1), and FIG. 3B is a sectional view at the through hole 11 of the belt guide 15 (along line 3B-3B of FIG. 1). As shown in FIGS. 3A and 3B, the belt guide 15 is held by a frame 33 of the ink jet printer, and the ink reservoir 16 with the foam 9 therein is disposed under the belt guide 15.

Since the inner belt 31 has a high strength as mentioned above, smooth rotation of the inner belt 31 is prevented by the presence of an object which temporarily contacts the inner belt 31 during rotation. To avoid occurrence of such a problem, the inner belt 31 is held by the transfer rollers 12, 12 such that the inner belt 31 travels keeping a gap 134 between itself and the belt guide 15. In the upper surface of the belt guide 15, a recess 15*a* is formed by partially cutting a portion facing the inner belt 31. The above-mentioned gap 134 is provided between the bottom surface of the recess 15*a* and the inner belt 31. The outer belt 32, which rotates with the inner belts 31, travels on the belt guide 15, with its tension maintained so as to transfer the paper 1 without deflection. In FIG. 3B, the width L of the ink discharge area by the print head 6 is indicated.

The above-mentioned nip roller 19, which contributes to providing the tension to the outer belt 32, need not always be located so as to face the follower roller 12*b* as shown in FIG. 1.

Figure 4A:
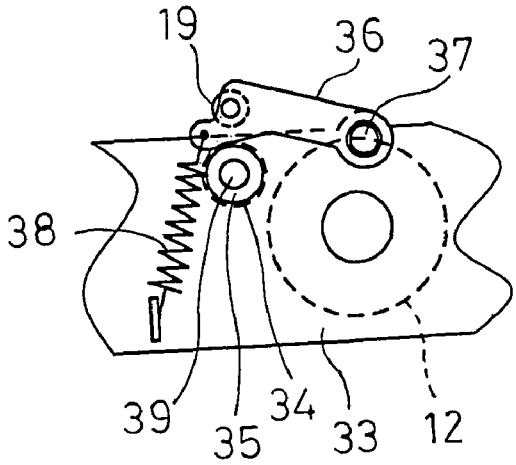
FIG. 4A is an enlarged view of a modification of a nip roller.
Figure 4B:
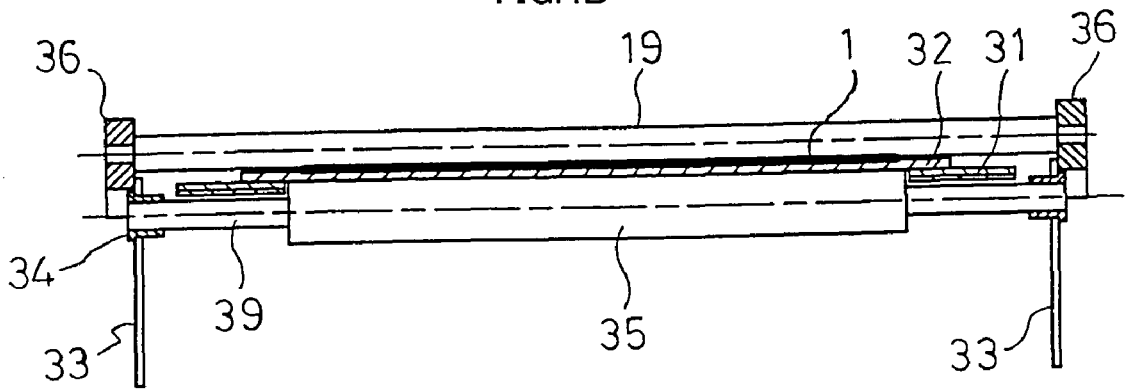
FIG. 4B is a sectional view thereof at a position without an opening.
Figure 4C:
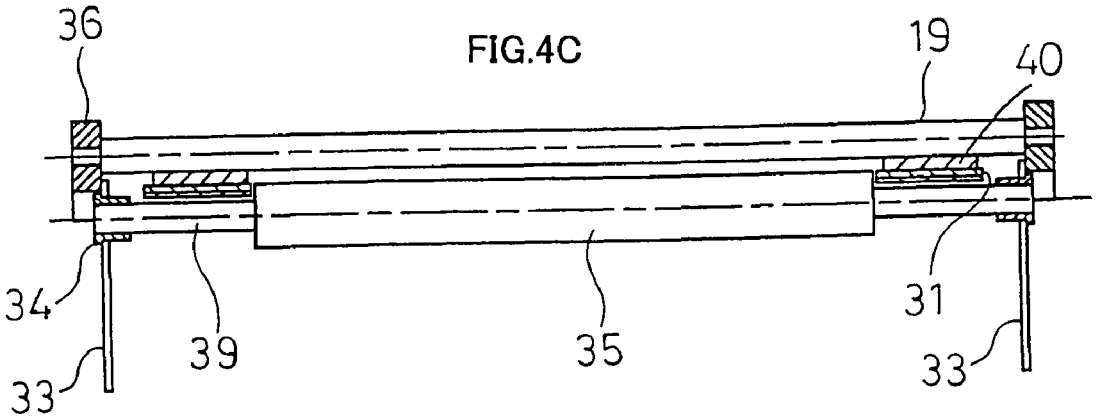
FIG. 4C is a sectional view thereof at a position with an opening.

FIGS. 4A through 4C are views showing a different location of the nip roller 19 from the location in FIG. 1. In this modification, the nip roller 19 is located at a position so as not to press the transfer roller 12, while a receiving roller 35 to be biased by the nip roller 19 is provided. The nip roller 19 is rotatably held by arms 36, and the arms 36 are rotatably held by a spindle 37 attached to the frame 33 supporting the transfer roller 12. A spring 38 for biasing the nip roller 19 toward the receiving roller 35 is fixed at the end of the arm 36. The receiving roller 35 is coaxially attached to a shaft 39 supported by the frame 33 through bushes 34. As shown in FIG. 4B, the paper 1 is nipped between the nip roller 19 and the receiving roller 35, while being pressed by the nip roller 19 to come into close contact with the upper surface of the outer belt 32. FIG. 4C is a view showing an after-mentioned modification, in which a belt provided with a member for preventing level difference is nipped by the nip roller. This view shows a state in which the opening 20 of the outer belt 32 comes under the nip roller 19. The preventing members 40 shown in FIG. 4C are provided for preventing the nip roller 19 from falling in the opening 20.

Figure 5:
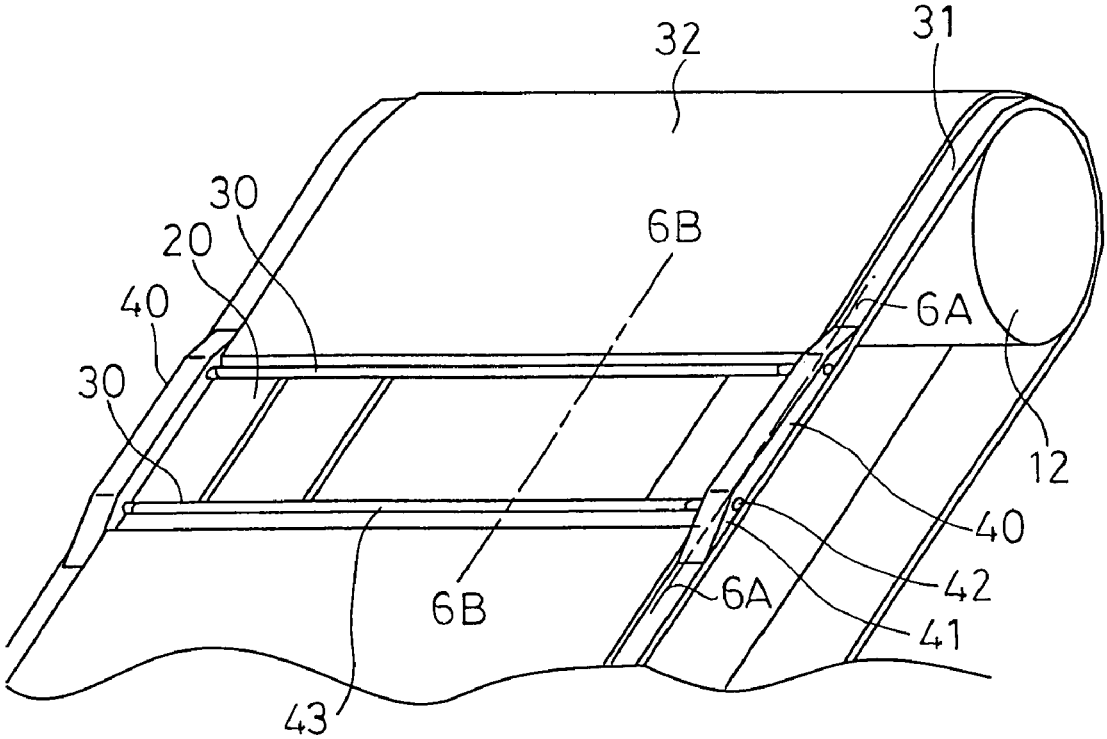
FIG. 5 is a perspective view for illustrating a member for preventing level difference.

As shown in FIG. 5, the preventing member 40 extends beyond the opening of the outer belt 32 onto the inner belt 31, and is gently tapered from the top portion to the bottom portion at both ends 41 of the preventing member 40. The height of the top portion of the preventing member 40 is approximately the same as the thickness of the outer belt 32.

The fixing structure of the outer belt will next be described with reference to FIG. 5, FIG. 6A, FIG. 6B, FIG. 7A and FIG. 7B.

Figure 6A:
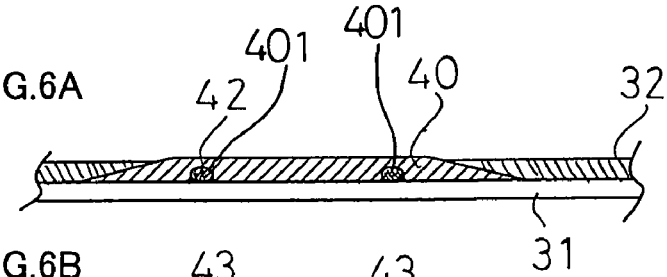
FIG. 6A is a sectional view along line 6A-6A of FIG. 5.
Figure 6B:
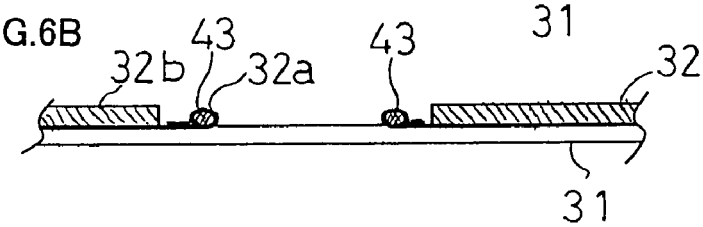
FIG. 6B is a sectional view along line 6B-6B of FIG. 5.

As shown in FIGS. 5, 6A and 6B, each of the reinforcing members 30 defining the opening 20 is wound around with the base belt 32*a* of the outer belt 32, and is deposited or adhered to the base belt 32*a* in the middle portion 43 of the reinforcing member 30. The each reinforcing member 30 has its both ends 42 projecting from the base belt 32*a*. A pair of right and left preventing members 40 respectively have receptacle holes 401 formed on the upstream side and the downstream side in the transfer direction. The preventing members 40 are adhesively fixed to the inner belt 31 with the receptacle holes 401 receiving the above ends 42. The ends 42 of the respective reinforcing members 30 are also adhered to the inner belt 31. The preventing members 40 are adhesively fixed to the inner belt 31. It is the above-mentioned adhesive layer 32*b* that is disposed on the base belt 32*a*.

A modification of the fixing structure is shown in FIG. 7A and FIG. 7B. As shown in FIG. 7B, the middle portion 43 of the reinforcing member 30 with a U-shaped cross section is designed to fix the outer belt 32 to the reinforcing member 30 by holding the end of the base belt 32*a* within the inner side of the U-shaped portion, in a different manner from that in FIG. 6B.

As shown in FIG. 7A, the ends 42 of the reinforcing member 30 are fixed within the preventing members 40, the same as in FIG. 6A. However, the ends 42 of the reinforcing member 30 are fixed not to the inner belt 31 but to the preventing members 40 and the base belt 32*a* by using an elastic adhesive 44. Also, the end 42 of the reinforcing member 30 has its edge 42*a* bent upward so as to reduce the adhesion area S with respect to the base belt 32*a* as much as possible.

This is to avoid a problem that when the reinforcing member 30 moves around the transfer roller 12, 12, a contact portion of the reinforcing member 30 having a large area presents a singularity, which causes the transfer speed to be changed, thereby causing deviation in the transfer amount.

It is, therefore, preferable to determine the width of the contact portion such that a singularity will not be presented in relation to the diameter of the transfer roller. Experiments show that the width should be one-tenths or less of the half of the circumferential length of the transfer roller 12. According to this arrangement, the deviation in ink density due to fluctuation in the transfer speed is hardly caused.

The use of the elastic adhesive 44 for fixing the ends 42 of the reinforcing member 30 is also to avoid the above-described problem by providing flexibility. The reinforcing member 30 is made, for example, of stainless steel.

A bump section 45 as an abutting portion shown in FIG. 7B is provided to properly position the paper on the outer belt 32, and has an abutting surface 46 for abutting an end of the paper 1.

Figure 8:
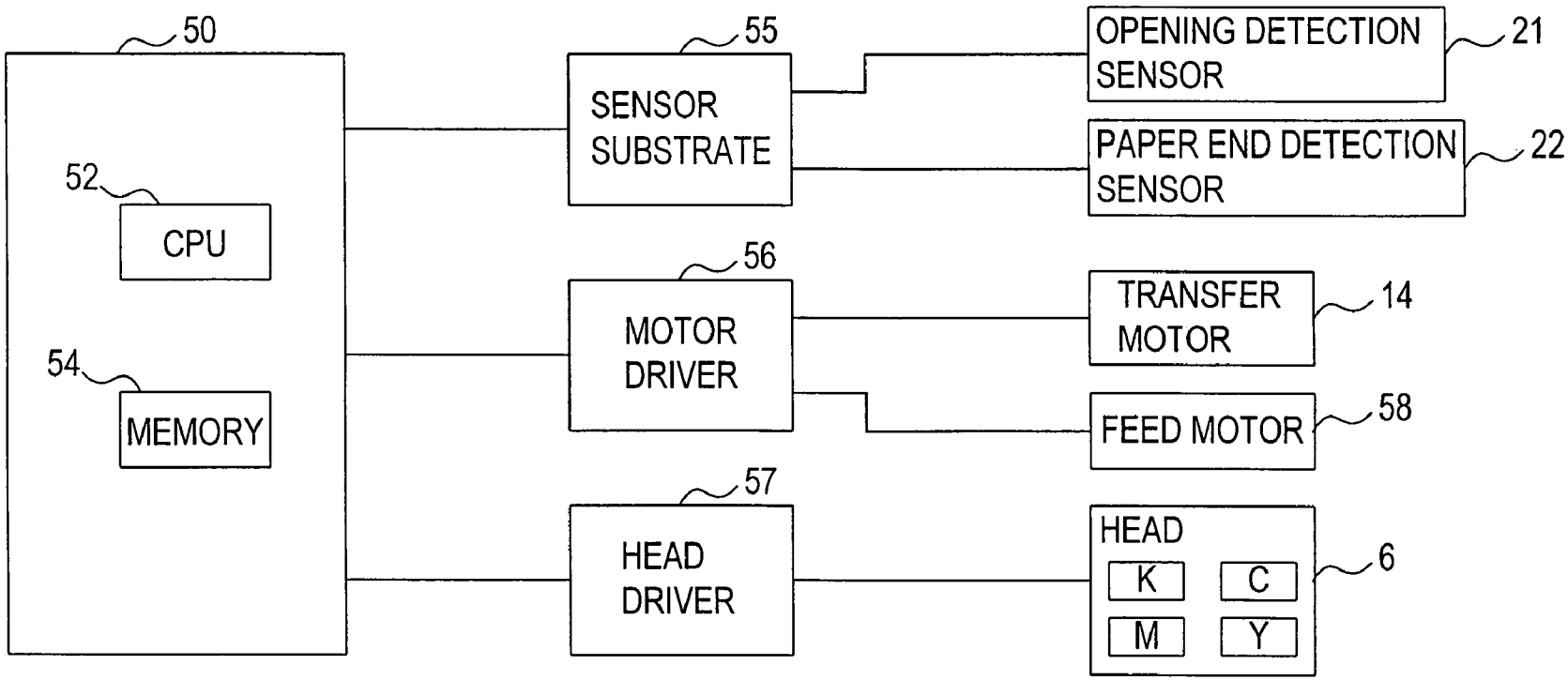
FIG. 8 is a block diagram illustrating the electrical structure of the control unit of the ink jet printer.

FIG. 8 is a view illustrating the constitution of a control unit of the ink jet printer. A control unit 50 as a control device is provided with a CPU 52 and a memory 54 for storing operation programs of the CPU 52 as well as a variety of data. The control unit 50 is connected to the opening detection sensor 21 and the paper end detection sensor 22 through a sensor substrate 55. The control unit 50 is also connected to the transfer motor 14 and a feed motor 58 for feeding paper through a motor driver 56. The control unit 50 is further connected to the print heads 6K, 6Y, 6M, 6C through a head driver 57. The feed motor 58 is designed to drive the above-mentioned pickup roller 2.

FIG. 9 is a flowchart illustrating the operation of the ink jet printer to which the present invention is applied. The operation of the ink jet printer will now be described with reference to FIG. 1 through FIG. 9.

In Step S1 (abbreviated to S1 in the drawing), the transfer motor 14 is driven. The transfer motor 14 continues to be driven until stopped in the after-mentioned Step S16.

In Step S2, standby operation is performed until the opening 20 of the outer belt 32 is detected by the opening detection sensor 21. When an opening detection signal indicating that the opening 20 has been detected is provided from the opening detection sensor 21, the CPU 52 starts an opening position counter indicating the position of the opening 20 (S3). The counter is incremented at every driving pulse of the transfer motor 14. Accordingly, the value of the opening position counter indicates the position of the opening 20 which changes every time the transfer motor 14 is driven by one pulse.

In Step S4, it is determined whether or not the value of the opening position counter has reached a predetermined value for paper feed timing.

If it is determined that the value for paper feed timing has been reached, the CPU 52 rotates the feed motor 58 to feed the paper 1 from the supply portion 3 and supply the paper 1 onto the transfer belt 10 in Step S5. Subsequently, the process proceeds to Step S6. When the pickup roller 2 is rotated by the feed motor 58, the paper 1 is fed from the supply portion 3 and supplied onto the transfer belt 10. The paper feed timing is set such that the front end of the paper will not cover the opening 20 of the transfer belt 10. This is because ink discharged during flushing of the head adheres to and dirties the paper when the opening 20 is covered. In view of the structure that the reinforcing members 30 are provided at an upstream end and a downstream end of the opening 20 in the transfer direction, the paper feed timing is further preferably set such that the paper is not to be placed on the reinforcing members. When the thickness of the reinforcing member 30 is not equal to the thickness of the outer belt 32 of the transfer belt 10, if an end of the paper is placed on the reinforcing member 30, the distances between the paper 1 and the respective print heads 6C, 6M, 6Y, 6K are made different depending on whether or not the paper 1 is on the reinforcing member 30.

This may cause separation of the paper 1 from the belt or shift of ink-landing-position, with the result that image forming cannot be performed properly. That is the reason why the paper feed timing is further preferably set such that an end of the paper is not to be placed on the reinforcing member 30.

When the bump section 45 for positioning paper (FIG. 7B) is provided to the transfer belt 10, the paper feed timing is set such that the front end of the paper 1 abuts the abutting surface 46 of the bump section 45.

The paper 1 supplied onto the transfer belt 10 is transferred in accordance with the rotation of the transfer belt 10, while being nipped and pressed by the transfer belt and the nip roller 19. Since the nip roller 19 is provided at a location so as to face the follower roller 12*b*, the paper 1 securely follows the transfer belt 10 in a curved portion of the transfer belt 10, and the transfer speed of the paper 1 can be maintained constant.

Since adhesion processing is performed to the outer belt 32 of the transfer belt 10, the holding power of the transfer belt 10 is strong, which results in an extremely high followability of the paper 1 to the transfer belt 10. Also, since the outer belt 32 having a high flexibility is spread over the inner belts 31 having a high strength, the transfer belt 10 is inhibited from being deflected, enabling transfer of the paper 1 without distortion or separation from the transfer belt 10. In addition, the outer belt 32 is stretched and attached to the inner belts 31 so as to absorb deflection of the transfer belt 10, and in the vicinity of the opening 20 around which stress is prone to be concentrated, the upstream end and the downstream end in the transfer direction are reinforced by the reinforcing member 30 so as to prevent deflection of the transfer belt 10. Thus, distortion or separation from the transfer belt 10 of the paper 1 at its front end in the transfer direction can be suppressed, which enables transfer of the paper 1 without trouble and appropriate image formation.

If it is determined in Step S4 that the paper feed timing has not been reached, the CPU 52 determines in Step S6 whether or not the paper end detection sensor 22 has detected the front end of the paper 1. If it is determined that the front end of the paper 1 has not been detected, the CPU 52 determines in Step S7 whether or not the opening 20 is facing the cyan head 6C based on the value of the opening position counter. Specifically, the value of the opening position counter when the opening 20 faces the cyan head 6C is set at a predetermined value, and it is determined that the opening 20 is facing the cyan head 6C if the value of the opening position counter has reached the predetermined value. If it is determined in Step S7 that the opening 20 is not yet facing the cyan head 6C, the process returns to the determination in Step S6. On the other hand, if it is determined that the opening 20 is facing the cyan head 6C, the CPU 52 performs flushing, which means discharging cyan ink from all of the ink discharge ports of the cyan head 6C for only a predetermined time period through the head driver 57, and then the process returns to Step S6.

Flushing of the cyan head 6C is performed first because the cyan head 6C is the closest to the supply portion 3 of the paper along the transfer direction of the transfer belt 10, as shown in FIG. 1, and the opening 20 of the transfer belt 10 first faces the cyan head 6C. When the layout of the heads is different from that in FIG. 1, flushing should be performed with respect to a head which faces the opening 20 first.

If it is determined in Step S6 that the front end of the paper has been detected, the CPU 52 resets and then starts a print line counter in Step S9. The print line counter indicates the position of the paper 1 changing in accordance with the movement of the transfer belt 10. Image forming data indicating an image to be formed on the paper 1 is transmitted in advance from an outside host computer and stored in the memory 54. The image forming data is created as dot data indicating whether or not to discharge ink from each of the ink discharge ports of the respective print heads 6C, 6M, 6Y, 6K for respective colors, with respect to each print line from the upstream side of the transfer direction of the paper.

A value of the print line counter indicates the position of the first line in the printing area of the paper 1 (the top position in the transfer direction). The image forming data consists of dot data for the cyan head, dot data for the magenta head, dot data for the yellow head, and dot data for the black head, with respect to each value of the print line counter.

In Step 10, it is determined whether or not the value of the opening position counter indicates that the opening is facing the magenta head 6M, the yellow head 6Y, or the black head 6K. If the answer is YES, flushing is performed with respect to the head facing the opening 20 in Step S11. Then the process proceeds to Step S12.

If it is determined that the opening 20 is not facing any of the heads, dot data for the respective heads corresponding to the value of the print line counter is read from the memory 54, and the respective heads are driven based on the dot data for the respective heads through the head driver 57 in Step S12.

Subsequently, in Step S13, it is determined whether or not printing of one page of the paper has been completed. If printing of one page has not been completed, the print line counter is incremented by one in Step S14, and the process returns to the determination in Step S10. Ink discharge from the respective heads is performed in a line-by-line manner as described above, so that an image is formed. During one pass of transfer in which the paper 1 passes the ink discharge areas of the respective heads without stopping, flushing is performed with respect to the respective heads before starting image formation. Accordingly, ink discharge ability can surely be restored to form an appropriate image. Since it is unnecessary to move the heads to an area for flushing as in a conventional manner, the required printing time will not be prolonged.

If it is determined in Step S13 that printing of one page of the paper has been completed, the CPU 52 determines whether or not printing of a specified number of copies has been completed (Step S15). If it is determined that printing of a specified number of copies has not been completed, the process returns to Step S2, and the CPU 52 waits the opening 20 to be detected again during another rotation of the transfer belt 10. After the opening is detected, the above described steps are repeatedly performed. On the other hand, if it is determined that printing of a specified number of copies has been completed, rotation of the transfer motor 14 is stopped in Step S16, and the printing process is terminated.

As mentioned above, the transfer belt 10 is spread around the roller 12, 12 with a predetermined tension and is rotated. The tension when the transfer belt 10 is spread causes the outer belt 32 to be also applied a tension through the inner belts. Since the stress is concentrated particularly at the ends of the outer belt 32 which define the opening 20, an outside force to stretch the opening 20 in the transfer direction is generated. However, since the reinforcing members 30 reinforce the entire upstream end and the entire downstream end of the outer belt 32, unevenness of the outer surface of the outer belt 32 due to wrinkles, for example, caused by deformation of the opening can be prevented. Accordingly, the paper is not separated from the surface of the belt, and therefore positional deviation of the paper can be avoided and the distance between the head and the paper is maintained appropriate. Thus, a high accuracy of ink-landing is achieved, resulting in appropriate image formation.

Modifications of the reinforcing member for reinforcing the opening 20 will next be described.

Figure 10A:
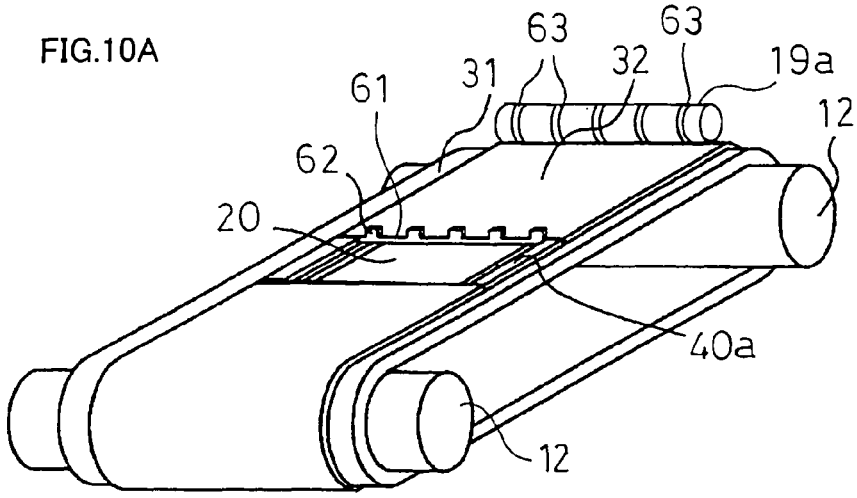
FIGS. 10A to 10C are schematic views illustrating modifications of the reinforcing portion.
Figure 10B:
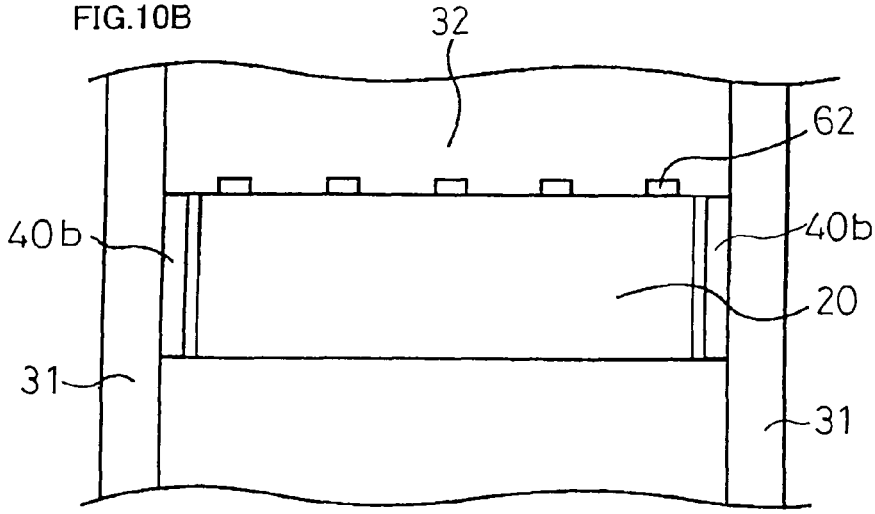
Figure 10C:
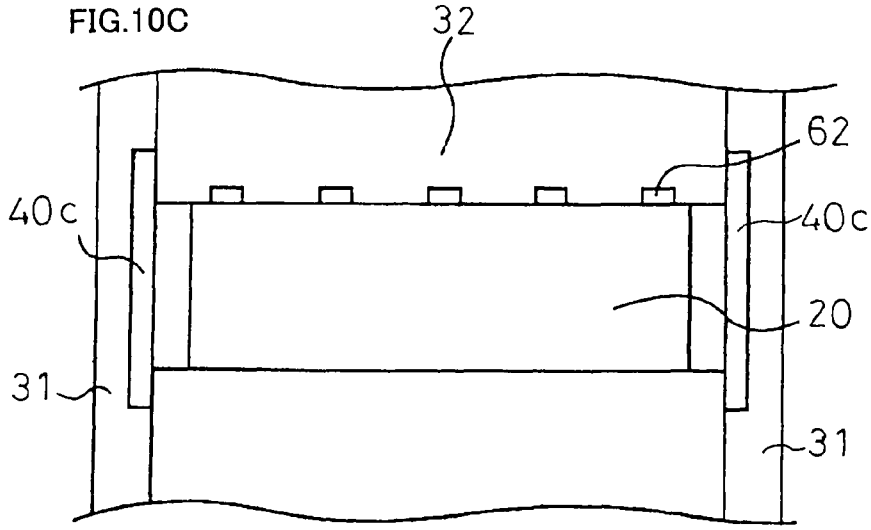

In the examples shown in FIGS. 10A through 10C, a plurality of projections 62 projecting from the surface of the outer belt 32 are provided at one end 61 of the outer belt 32. This enhances the strength in the vicinity of the opening 20, and thereby suppresses distortion in the vicinity of the opening 20 due to uneven distribution of stress generated around the opening 20 and the own weight of the outer belt.

In this case, as shown in FIG. 10A, the nip roller 19*a* should be provided with receiving grooves 63 formed corresponding to the arrangement of the projections 62 in order to prevent the nip roller 19*a* from running on to the projections 62. By this, the nip roller 19*b* will not be moved upward and downward when the end 61 as the reinforcing member passes the nip roller 19*a*, and an even pressure can be applied to the paper 1.

Also, when the side surfaces of the respective projections 62 are formed to be perpendicular to the transfer direction, the side surfaces may be used as butting portions for positioning the paper 1. The preventing members 40*a* are provided in the opening 20.

Preventing members 40*b* shown in FIG. 10B are disposed on the inner belts 31 such that both ends of the preventing members 40*b* in the transfer direction contact the both ends of the outer belt 32 in the transfer direction. Preventing members 40*c* shown in FIG. 10C have side surfaces perpendicular to the transfer direction which contact the side surfaces of the outer belt 32. The length of the preventing member 40*c* in the transfer direction in FIG. 10 is larger than the width of the opening 20 in the transfer direction defined by the outer belt 32. As a result, the side surfaces of the preventing members 40*c* are disposed in the vicinity of the opening 20 so as to overlap the side surfaces of the upstream side and the downstream side of the outer belt 32. This enables the nip roller 19*a* to move smoothly even in the opening 20.

Figure 11A:
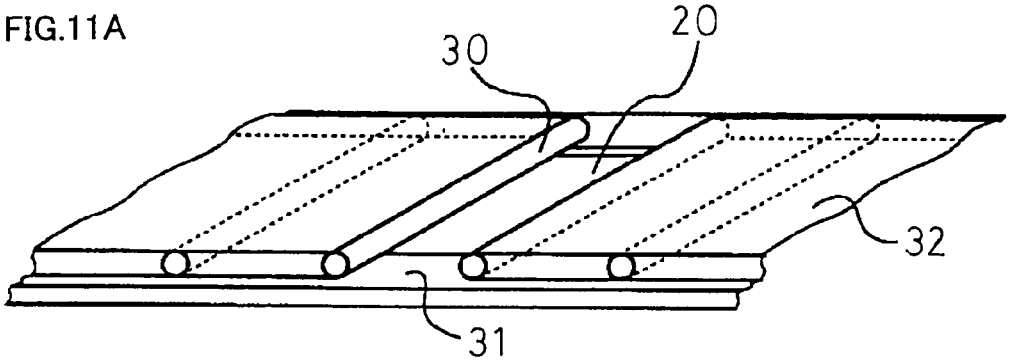
FIGS. 11A to 11C are schematic views illustrating further modifications of the reinforcing portion.
Figure 11B:
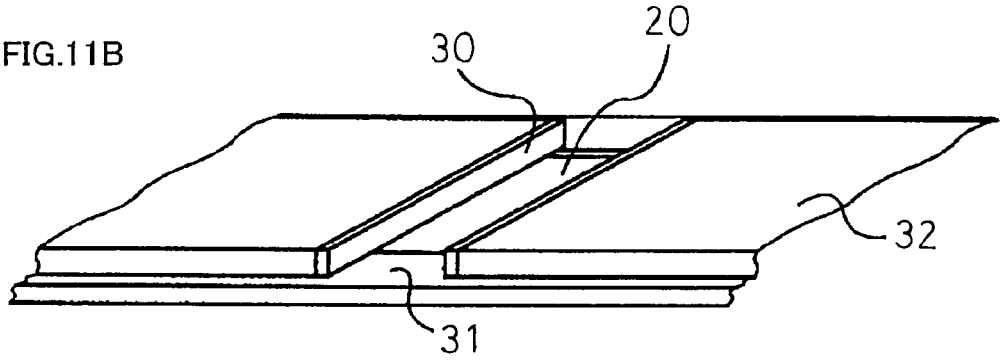
Figure 11C:
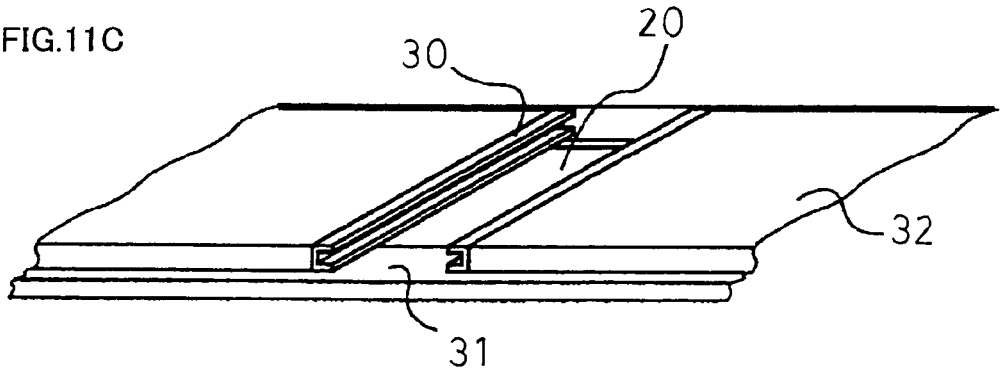

FIGS. 11A through 11C are schematic perspective views illustrating further modifications of the reinforcing member. The reinforcing member 30 should be formed of metal, such as a piano wire and stainless steel, so as to resist the deflection of the outer belt 32. The reinforcing member 30 may have a round bar-shaped configuration like a piano wire as shown in FIG. 11A, a plate-like configuration as shown in FIG. 11B, a U-shaped configuration as shown in FIG. 11C or an L-shaped configuration. The reinforcing members 30 may be formed to be embedded in the outer belt 32 in addition to the vicinity of the opening 20, as shown in FIG. 11B. For example, a core such as a piano wire may be embedded while forming the outer belt. When the reinforcing members 30 are embedded all over the outer belt, the strength is further enhanced to suppress distortion and deflection while maintaining elasticity of the elastic material.

It is preferable to determine the size of the reinforcing member 30 such that a singularity will not be presented in relation to the diameter of the transfer roller 12, for the same reason as described above.

In the mode of FIG. 11B or FIG. 11C, the reinforcing members 30 may be embedded in a portion of the outer belt 32 other than the opening 20.

The height of the reinforcing member 30 may be higher than the outer belt 32 in the case of serving as an abutting portion, but should be within a range of a head gap indicating the distance from the outer belt 32 to the print head 6, in order to prevent the reinforcing member 30 from contacting the print head 6 and damaging ink discharge ports or being spoiled with ink.

Figure 12:
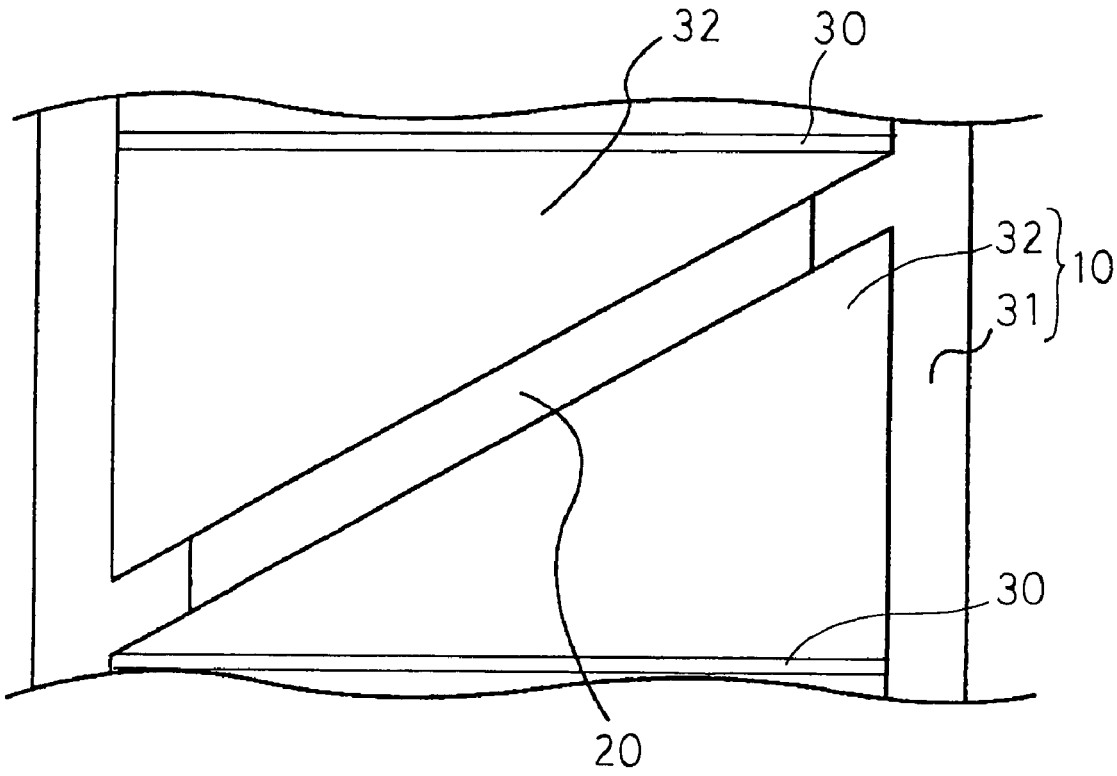
FIG. 12 is a schematic view illustrating a modification of the opening.

FIG. 12 is a top view showing a transfer belt having an opening 20 formed by arranging the upstream end and the downstream end of the outer belt 32 in the transfer direction in an oblique manner with respect to the transfer direction. Since the stress is concentrated in the vicinity of the opening 20 as described above, the transfer belt 10 is prone to be distorted. In the present embodiment, distortion is designed to be suppressed by employing a two-layer structure consisting of the outer belt 32 and the inner belts 31 and providing the reinforcing members 30 at the opening 20. In addition, when the opening 20 is formed in an oblique manner as shown in FIG. 12, the width of the opening 20 in the direction perpendicular to the transfer direction is smaller compared with the length of the opening 20 in the oblique direction, with the result that concentration of the stress due to the tension applied along the transfer direction or the direction perpendicular to the transfer direction of the transfer belt 10 can be reduced. Although the distortion of the transfer belt 10 is minimized when an oblique angle of 45 degrees in relation to the direction perpendicular to the transfer direction is employed, such an oblique angle results in a smaller transfer area which can be used for transferring the paper 1. Therefore, the oblique angle may be, for example, 20 degrees or 30 degrees. The respective print heads are arranged in an oblique manner so as to correspond to the oblique direction of the opening.

Even when the opening 20 is formed in an oblique manner as shown in FIG. 12, the reinforcing members 30 are provided so as to extend in the direction perpendicular to the transfer direction. This is because the reinforcing members 30 provided in an oblique manner may cause a problem in rotation of the transfer belt 10.

While the above description is provided concerning the case in which the outer belt is an open-ended belt, the case of an endless belt will next be described.

Figure 13A:
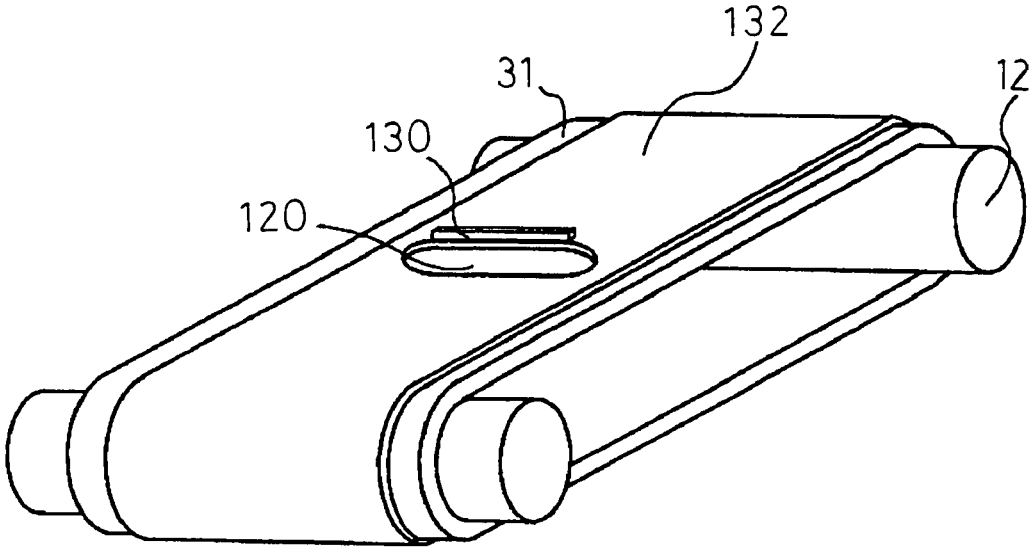
FIGS. 13A and 13B are schematic views illustrating an opening in the case of using an endless belt.
Figure 13B:
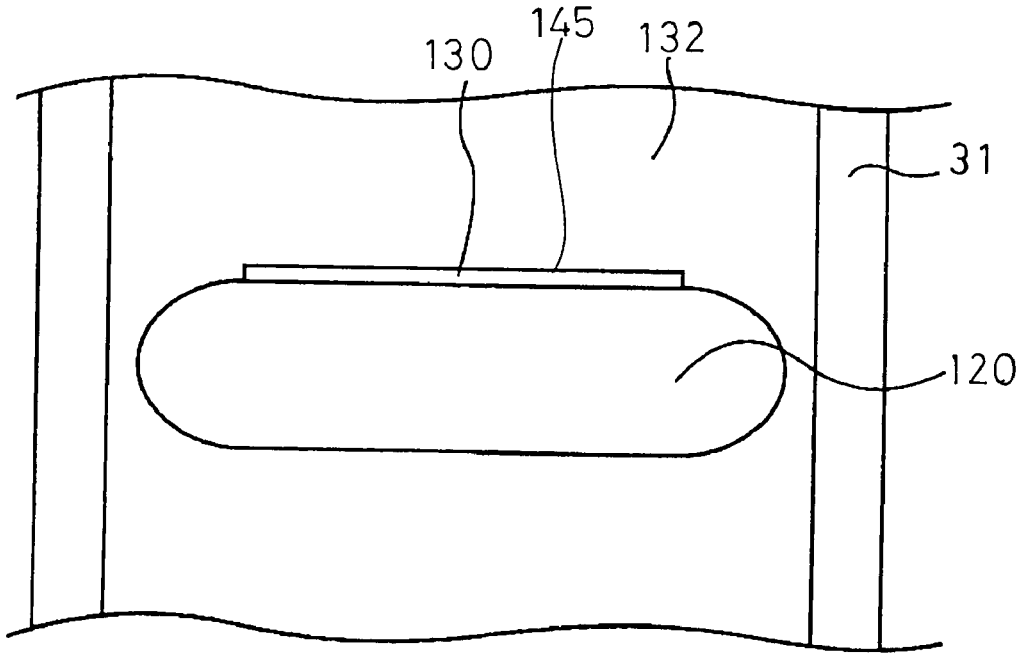

FIG. 13A is a schematic perspective view of a transfer belt comprising an endless outer belt with a hole formed as an opening, and a reinforcing member for reinforcing the vicinity of the opening and also serving as a butting portion. FIG. 13B is a top view of the vicinity of the opening of the transfer belt.

In this embodiment, a butting portion 145 is formed by one projection. When an opening 120 is formed by making a hole in the surface of an outer belt 132, the configuration, the angle, and the number of the openings 120 may be freely determined. Accordingly, it is possible to provide an optimum opening 120 adapted to the specification of an ink jet printer in which the transfer belt is to be mounted. Furthermore, since the inner belts 31 are not exposed, bumpy or sudden movement corresponding to the thickness of the outer belt 132 is not caused when the nip roller passes the opening 120. In the same manner as in the opening 20 shown in FIG. 10A, a reinforcing member 130 is formed by increasing the thickness, which results in an increased strength in the vicinity of the opening 120. It is, therefore, possible to suppress distortion in the vicinity of the opening 120 due to uneven distribution of stress caused in the vicinity of the opening 120 and the own weight of the outer belt 132. Also in this case, the side surface of the reinforcing member 130 may be used as the butting portion 145 for positioning the paper 1.

Figure 14:
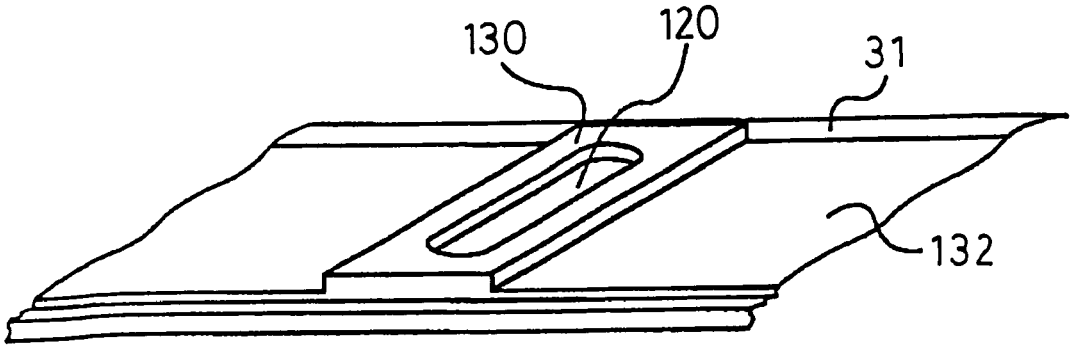
FIG. 14 is a schematic view illustrating a modification of the opening.

FIG. 14 is a schematic perspective view of the vicinity of the opening 120 of a transfer belt, in which a reinforcing member 130 is formed by increasing the thickness of an outer belt 132 in the vicinity of the opening 120. An increased strength provided by the increased thickness enables suppression of distortion of the opening 120 due to the stress. Also in this case in which the reinforcing member 130 is made of the same elastic material as the outer belt 132, any singularity is not presented while the reinforcing member 130 moves around the transfer roller 12, unlike the case with a metal reinforcing member. Therefore, it is possible to form the reinforcing member with a large width in the transfer direction so as to further increase the strength. It is also possible to form the side surfaces of the reinforcing member which may cause a level difference to be gently sloped so that smooth movement of the nip roller will not be obstructed. The reinforcing member 130 is formed by integral molding when the outer belt 132 is manufactured. Since the height of the reinforcing member 130 is larger than the thickness of the outer belt 132, a non-sloped side surface of the reinforcing member 130 can serve as a butting portion. The height should be within a range of a head gap indicating the distance from the outer belt 132 to the print head 6, the same as in the above described case of the reinforcing member 130 made by using metal.

Figure 15:
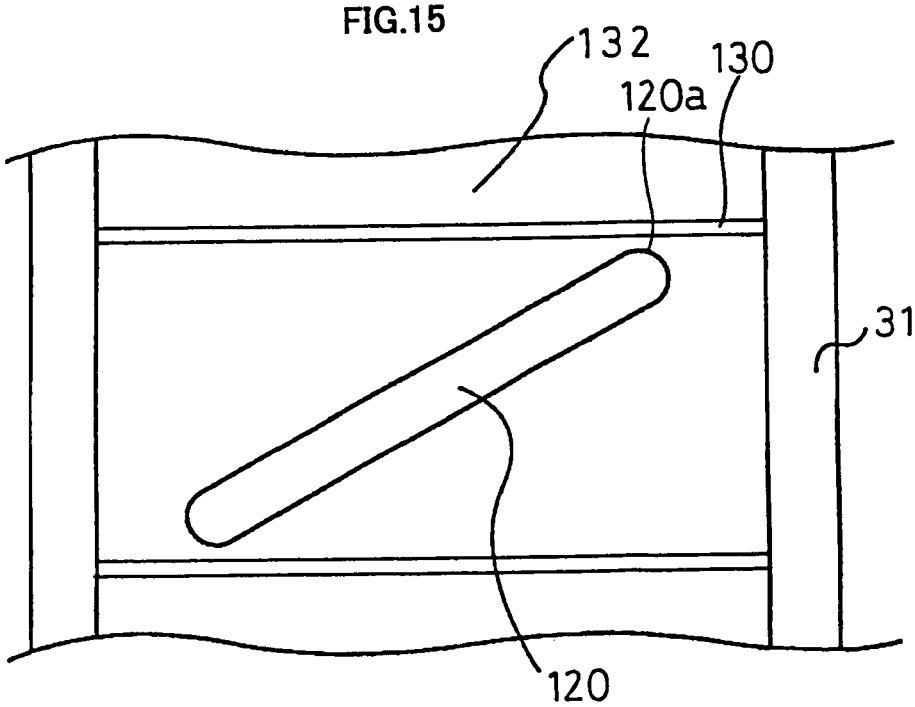
FIG. 15 is a schematic view illustrating a modification of the opening.

FIG. 15 is a view showing an endless belt having an opening 120 formed in an oblique manner. By providing the opening 120 in an oblique manner, concentration of the stress can be reduced, the same as in the above described case of the open-ended belt. By forming corners 120*a* of the opening 120 in a circular configuration as shown in FIG. 15, concentration of the stress can be further reduced. The reinforcing member 130 is provided so as to extend in the direction perpendicular to the transfer direction, the same as in the case of FIG. 13.

Figure 16:
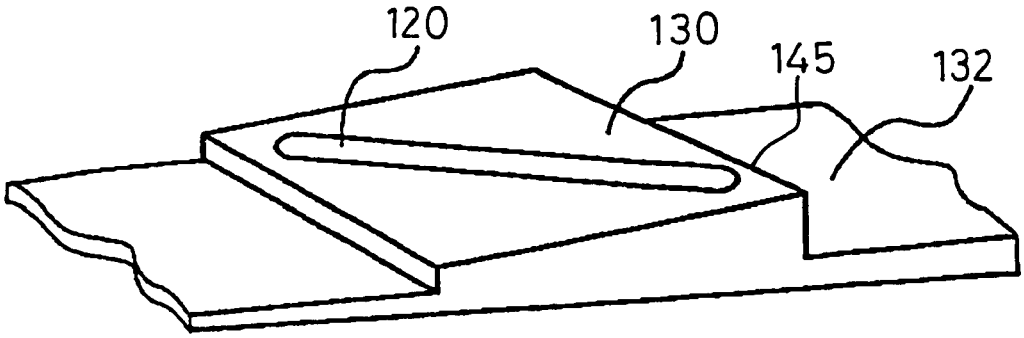
FIG. 16 is a schematic view illustrating a modification of the opening.

FIG. 16 is a top view illustrating the vicinity of an opening 120 of a transfer belt having the opening 120 formed in an oblique manner and varying thicknesses in the vicinity of the opening 120. The distortion of the opening 120 due to the stress is suppressed by the increased strength brought by a reinforcing member 130 formed by thickening the vicinity of the opening 120 of the outer belt 132 in addition to the reduced stress by the oblique opening 120. It may also be possible, as shown in FIG. 16, to vary the thickness of the belt around the opening 120 and use a thicker side as the butting portion 145, while gently sloping a thinner side so as not to obstruct smooth movement of the nip roller.

In the present embodiment, as described above, the transfer belt has a two-layer structure comprising the inner belts having a substantial degree of strength and the outer belt having the opening, and the reinforcing member is provided around the opening to reduce distortion due to the stress.

In the above described embodiment, both of the upstream end and the downstream end of the outer belt are fixed to the inner belt. However, it may be possible to fix only the upstream end to the inner belts by providing a slack prevention device for preventing slack of the transfer belt. A transfer belt having such a structure will be described below.

Figure 17:
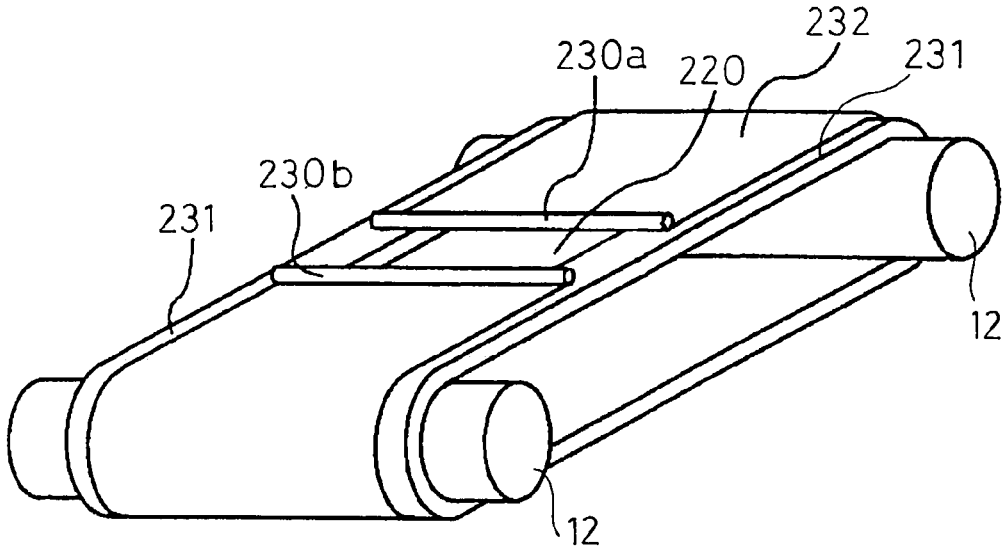
FIG. 17 is a schematic view illustrating a modification of a transfer belt.

As shown in FIG. 17, a transfer sheet 232 constituting an outer belt layer is wound around drive members 231 constituting an inner belt layer. The drive members 231 comprise two timing belts (toothed belts) commonly used for transfer. The use of the timing belts is advantageous in that timing of transfer can be adjusted by the number of teeth and, therefore, deviation of transfer can be prevented from being caused.

The drive member 231 is not limited to a belt, but may be any member having transfer force, such as a wire. The use of a wire having a smaller width than that of a belt enables a smaller width of the transfer mechanism, which will be helpful in downsizing a device.

The transfer sheet 232 comprises a very thin flexible sheet having a thickness of approximately 0.1 mm-0.3 mm, and both upstream and downstream ends in the transfer direction of the transfer sheet 232 are provided, respectively, with an upstream reinforcing member 230*a* and a downstream reinforcing member 230*b*. The upstream end and the downstream end form an opening 220 therebetween. The use of a flexible sheet results in a good followability of the paper 1, and facilitates formation of a flat surface. Adhesion processing may be performed on the transfer sheet 232 for properly holding the paper 1, or a separate adhesive sheet may be disposed on the transfer sheet 232. As the reinforcing members 230*a* and 230*b*, a strong material like stainless steel or, for example, a bar-shaped piano wire is used. When only paper of A4 size is used, a piano wire having a diameter of 1.5 mm to 2 mm is employed in the case with the transfer sheet having a width of 220 mm and the bar-shaped reinforcing members 230 *a*, b.

The function of the opening 220 is allowing recovery discharge of the print head, the same as in the above described embodiments.

In the present embodiment, the drive members 231 and the transfer sheet 232 are connected by directly joining only the upstream reinforcing member 230*a* and the drive members 231, while the remaining portion of the transfer sheet 232 is not joined to the drive members 231. Accordingly, the transfer sheet 232, which is not pulled directly by the drive members 231, is not subjected to a force in the perpendicular direction to the transfer direction. Thus, distortion of the sheet due to uneven stress can be prevented. Furthermore, by pressing the transfer sheet 232 using the nip roller in the same manner as in the above embodiments, the transfer sheet 232 is biased toward the downstream direction and thereby is given a tension. Thus, the flatness of the transfer sheet 232 is maintained. Also, it may be possible to provide the tension by designing the nip roller (not shown in FIG. 17) to have rotational resistance. Rotational resistance may be developed, for example, by providing a member for generating friction to the holding portion of the nip roller.

Figure 18:
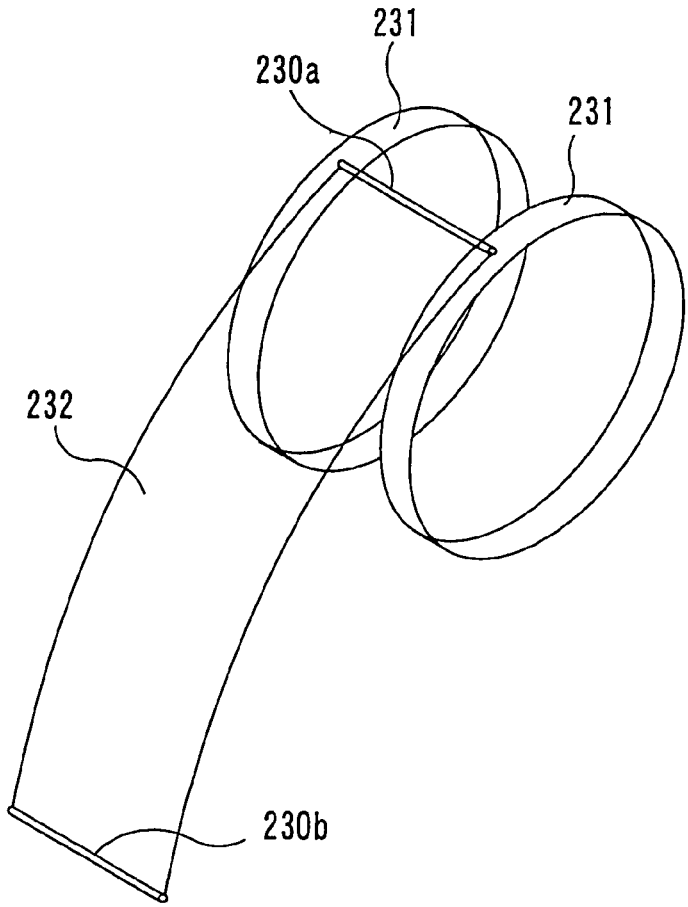
FIG. 18 is a schematic view illustrating the structure of the transfer belt.

As shown in FIG. 18, the transfer sheet 232 may be provided as a replacement part which is detachably attached to the two drive members 231. The upstream reinforcing member 230*a* may be fixed to the drive members 231 by bonding or welding, or may be attached to the drive members 231 by snapping engagement using clips and the like. The transfer sheet 232 is wound onto the drive members 231 which are stretched between a plurality of transfer rollers. The downstream reinforcing member 230*b* is biased in the below-indicated manner, and the transfer sheet is used without going slack.

An example of the slack prevention device will next be described with reference to FIG. 19A and FIG. 19B. Although springs 250 which are elastic members are used as a biasing device in this example, any elastic member may be employed as long as the elastic member can provide biasing force to the upstream reinforcing member 230*a* and the downstream reinforcing member 230*b*.

Figure 19A:
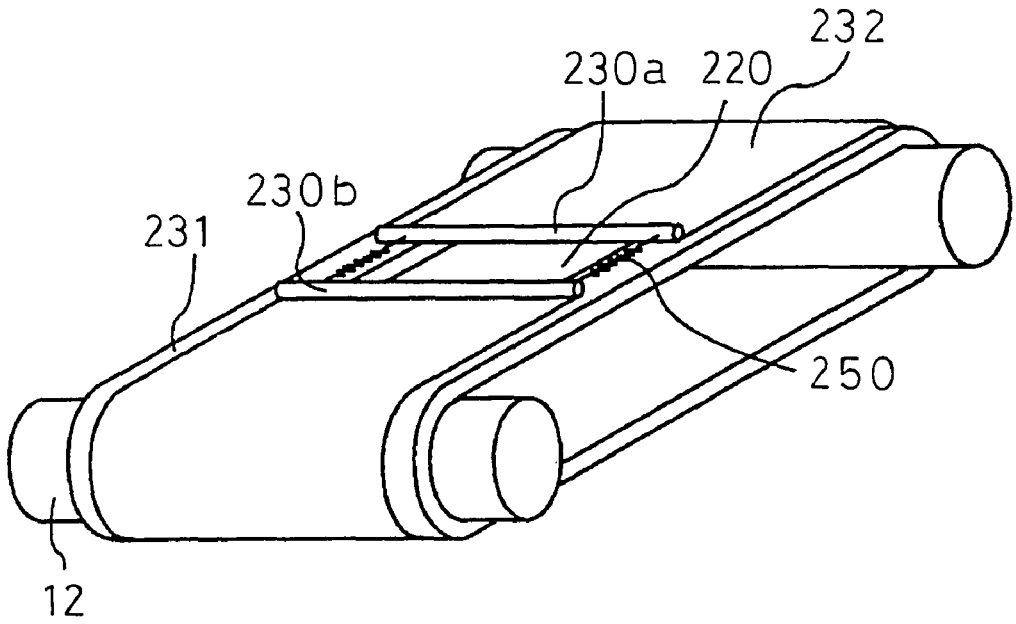
FIGS. 19A and 19B are schematic views illustrating a fixing structure of the transfer belt.
Figure 19B:
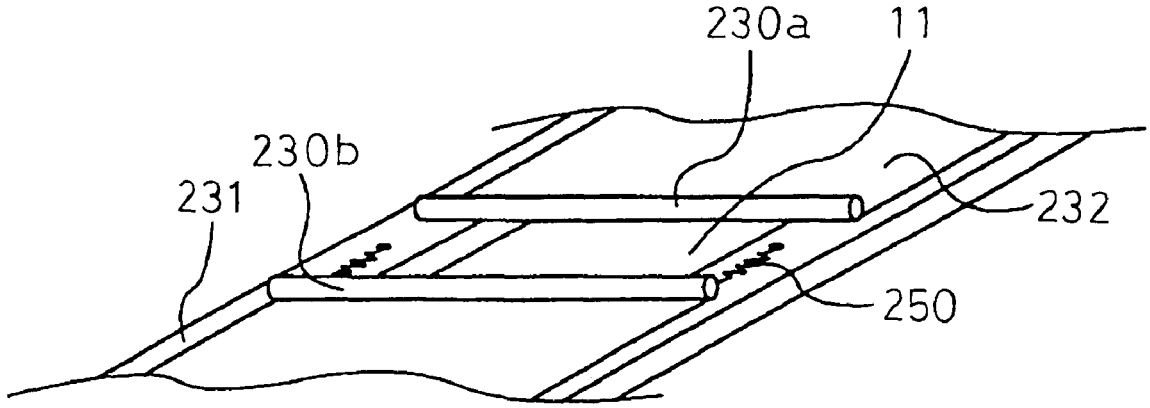

In the example shown in FIG. 19A, the transfer sheet 232 is fixed to the drive members 231 at parts at which the upstream reinforcing member 230*a* contacts the drive members 231. Since the transfer sheet 232 downstream from the parts is not directly fixed to the drive members 231, stress is not applied directly to the transfer sheet 232 by the drive members 231. Thus, distortion of the sheet due to an uneven distribution of stress can be prevented. Also, the springs 250 are stretched between the upstream reinforcing member 230*a* and the downstream reinforcing member 230*b*. If the circumferential length of the drive member 231 is exactly equal to the circumferential length of the transfer sheet 232, the transfer sheet 232 will not be deflected in the transfer direction. However, since a certain degree of manufacturing error is unavoidable, the flatness of the transfer sheet 232 is designed to be maintained by providing a tension by the springs 250 toward the downstream side in the transfer direction.

The springs 250 may be fixed to the upstream reinforcing member 230*a* and the downstream reinforcing member 230*b* so as to connect the both ends of the transfer sheet 232, as shown in FIG. 19A. Also, as shown in FIG. 19B, it may be possible to fixedly connect one end of the each spring 250 to the drive member 231 and connect the other end to the downstream reinforcing member 230*b*. According to these constitutions, the springs 250 provide the transfer sheet 232 with a tension toward the downstream in the transfer direction, and thus the flatness of the transfer sheet 232 is maintained.

Figure 20:
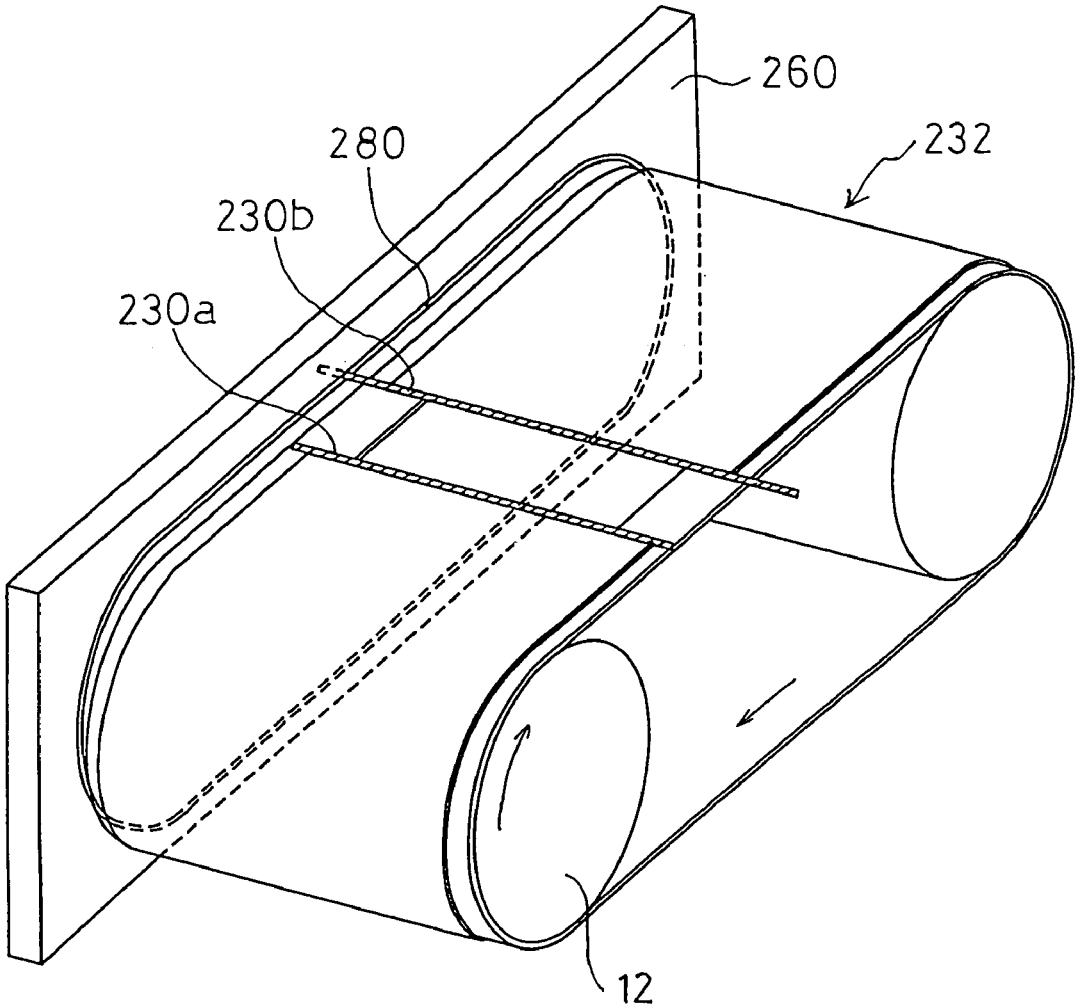
FIG. 20 is a schematic view illustrating a mechanism for applying resistance to the transfer belt.
Figure 21A:
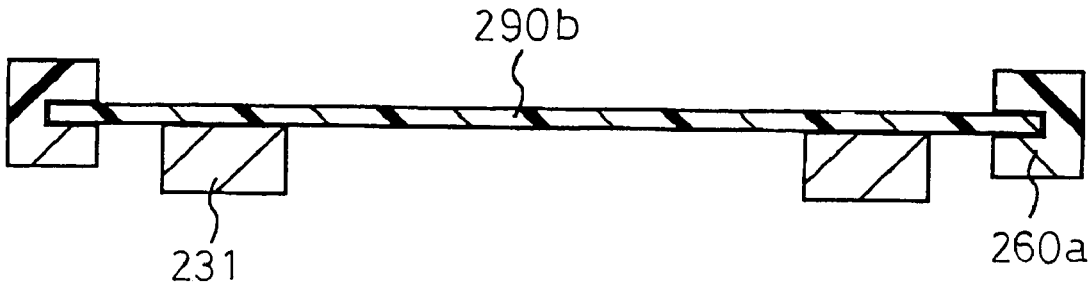
FIGS. 21A and 21B are schematic views illustrating mechanisms for applying resistance to the transfer belt.
Figure 21B:
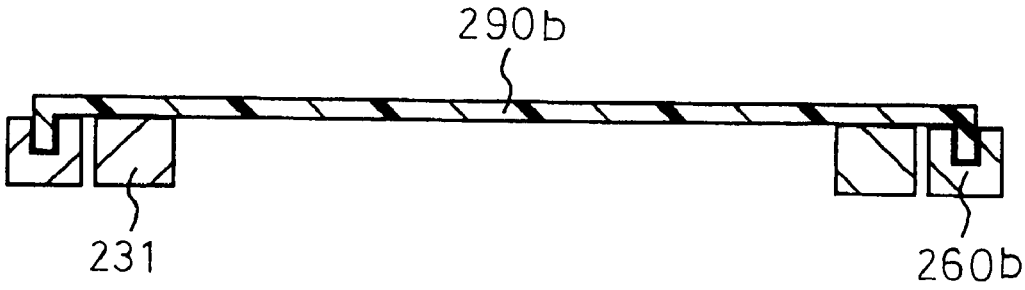

A mechanism for providing a given resistance so as to prevent slack will next be described. FIG. 20, FIG. 21A and FIG. 21B show embodiments, in which a guide member 260 is used as a resistance providing device. The guide member 260 for guiding the transfer sheet 232 is designed to have frictional resistance since the transfer sheet 232 can be biased by providing such frictional resistance thereto.

Although FIG. 20 shows the guide member 260 on only one side of the transfer sheet 232, it is to be understood that the guide members 260 are disposed actually on both sides of the transfer sheet 232. The guide member 260 is provided with a guide groove 280 formed along the transfer sheet 232. The length of the downstream reinforcing member 230*b* is longer than the length of the upstream reinforcing member 230*a*, and the end of the downstream reinforcing member 230*b* is inserted into the guide groove 280. In the case of FIG. 20, the rotating direction of the transfer roller 12 is clockwise.

A guide member 260*a* may be provided outside the drive member 231 such that the guide groove 280 may receive a downstream reinforcing member 290*b* from a lateral direction, as shown in FIG. 21A. A guide member 260*b* also may be provided so as to receive a downstream reinforcing member 290*b* having an L-shaped configuration from the upper direction, as shown in FIG. 21B. By forming the internal side of the guide member 260, 260*a* or 260*b* with a member which provides frictional resistance, such as sponge, it is possible to provide frictional resistance to the transfer sheet 232 and thereby bias the transfer sheet 232 toward the downstream direction while guiding the transfer sheet 232 not to travel obliquely.

In an ink jet printer according to one of these embodiments, the movement of the transfer sheet 232 in the transfer direction is restricted by the guide member 260, 260*a* or 260*b*, and thus straight movement of a recording medium in the transfer direction can be effectively secured.

INDUSTRIAL AVAILABILITY

The present invention is applicable to an image forming apparatus, particularly to an ink jet printer. The present invention is advantageous in that deflection or distortion of a transfer belt having an opening in the image forming apparatus can be prevented and that recovery discharge can be performed within a short time period.

What is claimed is:

1. An image forming apparatus provided with a print head for ejecting ink onto a recording medium to form an image and a transfer mechanism for transferring the recording medium to an image forming area in which the image is formed by the print head, the transfer mechanism comprising:

at least two rollers arranged at a predetermined distance apart from each other, at least one of the rollers being rotationally driven;

an inner belt layer including two inner belts circularly wound around the at least two rollers at a predetermined distance apart from each other such that an inner surface of each of the inner belts abuts the at least two rollers; and an outer belt layer arranged so as to abut an outer surface of each of the inner belts, for placing the recording medium thereon, the outer belt layer rotating with the inner belts, wherein the outer belt layer has an opening for allowing recovery discharge of the print head and a reinforcing portion provided along a periphery of the opening for maintaining the configuration of the opening, and wherein the outer belt layer is an open-ended belt, wherein both ends of the open-ended belt define the opening of the outer belt layer, and wherein the reinforcing portion is provided at least at one of the both ends of the open-ended belt.

2. The image forming apparatus as set forth in claim 1, wherein each of the inner belts is arranged at each side end of the outer belt layer.

3. The image forming apparatus as set forth in claim 1, wherein the inner belt is made of a material having a strength higher than the strength of the material of the outer belt layer.

4. The image forming apparatus as set forth in claim 3, wherein the inner belt is made of metal and the outer belt layer is made of synthetic resin.

5. The image forming apparatus as set forth in claim 4, wherein the outer belt layer includes a base belt layer as a base and an adhesive belt layer provided on the base belt layer for placing the recording medium thereon.

6. The image forming apparatus as set forth in claim 5, wherein the reinforcing portion has a U-shaped cross section and wherein an end of the base belt layer is held within the U-shaped reinforcing portion.

7. The image forming apparatus as set forth in claim 1, wherein the reinforcing portion is provided along the entire length of the end of the open-ended belt.

8. The image forming apparatus as set forth in claim 1, wherein the outer belt layer is an endless belt, wherein the opening is provided in the endless belt, and wherein the reinforcing portion is provided so as to surround at least part of the opening.

9. The image forming apparatus as set forth in claim 8, wherein the reinforcing portion is formed by increasing the thickness of part of the endless belt.

10. The image forming apparatus as set forth in claim 1, wherein the opening is provided obliquely with respect to the transfer direction of the outer belt layer.

11. The image forming apparatus as set forth in claim 1, wherein the outer belt layer includes an abutting portion for abutting an end of the recording medium when the recording medium is supplied to the transfer mechanism from the outside.

12. The image forming apparatus as set forth in claim 11, wherein the abutting portion includes an end surface extending in a direction perpendicular to the transfer direction of the reinforcing portion.

13. The image forming apparatus as set forth in claim 1, wherein the length of the reinforcing portion along the rotating direction of the roller is one-tenths or less of half of the circumferential length of the roller.

14. The image forming apparatus as set forth in claim 1, wherein the transfer mechanism further comprises a nip roller for placing the recording medium in close contact with the outer belt layer, and wherein the inner belt is provided with a member for preventing the nip roller from falling in the opening when the opening of the outer belt layer comes to the position of the nip roller.

15. The image forming apparatus as set forth in claim 14, wherein the preventing member has a top portion extending longer than the length of the opening in the transfer direction.

16. An image forming apparatus provided with a print head for ejecting ink onto a recording medium to form an image and a transfer mechanism for transferring the recording medium to an image forming area in which the image is formed by the print head, the transfer mechanism comprising:

at least two rollers arranged at a predetermined distance apart from each other, at least one of the rollers being rotationally driven;

an inner belt layer including two inner belts circularly wound around the at least two rollers at a predetermined distance apart from each other such that an inner surface of each of the inner belts abuts the at least two rollers; and an outer belt layer arranged so as to abut an outer surface of each of the inner belts, for placing the recording medium thereon, the outer belt layer rotating with the inner belts, wherein the outer belt layer has an opening for allowing recovery discharge of the print head and a reinforcing portion provided along a periphery of the opening for maintaining the configuration of the opening, wherein the transfer mechanism further comprises a nip roller for placing the recording medium in close contact with the outer belt layer, wherein the reinforcing portion is provided with a projection having a predetermined configuration and projecting from the outer belt, and wherein the nip roller is provided with a receiving groove capable of receiving the projection of the reinforcing portion so that the nip roller is prevented from running on to the projection.

17. An image forming apparatus provided with a print head for ejecting ink onto a recording medium to form an image and a transfer mechanism for transferring the recording medium to an image forming area in which the image is formed by the print head, the transfer mechanism comprising:

at least two rollers arranged at a predetermined distance apart from each other, at least one of the rollers being rotationally driven;

an inner belt layer including two inner belts circularly wound around the at least two rollers at a predetermined distance apart from each other; and an outer belt layer arranged so as to abut outer surfaces of the inner belts for placing the recording medium thereon, the outer belt layer rotating with the inner belts, wherein the outer belt layer has an opening for allowing recovery discharge of the print head and a reinforcing portion provided around the opening for maintaining the configuration of the opening, the outer belt layer is an open-ended belt, wherein both ends of the open-ended belt define the opening of the outer belt layer, and the reinforcing portion is provided at least at one of the both ends of the open-ended belt.

18. An image forming apparatus provided with a print head for ejecting ink onto a recording medium to form an image and a transfer mechanism for transferring the recording medium to an image forming area in which the image is formed by the print head, the transfer mechanism comprising:

at least two rollers arranged at a predetermined distance apart from each other, at least one of the rollers being rotationally driven;

an inner belt layer including two inner belts circularly wound around the at least two rollers at a predetermined distance apart from each other; and an outer belt layer arranged so as to abut outer surfaces of the inner belts for placing the recording medium thereon, the outer belt layer rotating with the inner belts, wherein:

the outer belt layer has an opening for allowing recovery discharge of the print head and a reinforcing portion provided around the opening for maintaining the configuration of the opening, the transfer mechanism further comprises a nip roller for placing the recording medium in close contact with the outer belt layer, the reinforcing portion is provided with a projection having a predetermined configuration and projecting from the outer belt, and the nip roller is provided with a receiving groove capable of receiving the projection of the reinforcing portion so that the nip roller is prevented from running on to the projection.

* * * * *